US011486110B2

(12) United States Patent
Gupta

(10) Patent No.: US 11,486,110 B2
(45) Date of Patent: Nov. 1, 2022

(54) POROUS DISPLACEMENT PILES MEETING FILTER DESIGN CRITERIA FOR RAPID CONSOLIDATION AND DENSIFICATION OF SUBSURFACE SOILS AND INTERMEDIATE GEOMATERIALS

(71) Applicant: Ramesh Chandra Gupta, Ashburn, VA (US)

(72) Inventor: Ramesh Chandra Gupta, Ashburn, VA (US)

( * ) Notice: Subject to any disclaimer, the term of this patent is extended or adjusted under 35 U.S.C. 154(b) by 0 days.

(21) Appl. No.: 17/556,364

(22) Filed: Dec. 20, 2021

(65) Prior Publication Data

US 2022/0136198 A1 May 5, 2022

Related U.S. Application Data

(63) Continuation-in-part of application No. 17/090,858, filed on Nov. 5, 2020, now Pat. No. 11,261,576.

(51) Int. Cl.
*E02D 5/24* (2006.01)
*E02D 3/12* (2006.01)
(Continued)

(52) U.S. Cl.
CPC ..... *E02D 3/123* (2013.01); *E02D 3/08* (2013.01); *E02D 5/24* (2013.01); *E02D 7/02* (2013.01); *E02D 2200/1685* (2013.01)

(58) Field of Classification Search
CPC .. E02D 3/08; E02D 5/24; E02D 27/16; E02D 5/385; E02D 27/18; E02D 2250/0007;
(Continued)

(56) References Cited

U.S. PATENT DOCUMENTS 4,126,007 A * 11/1978 Mars ..... E02D 3/08 405/271
5,800,090 A * 9/1998 Goughnour ..... E02D 3/10 405/36

(Continued)

FOREIGN PATENT DOCUMENTS

EP 0 936 040 B1 8/2004

OTHER PUBLICATIONS

Bhutta, A.M.R., Tsuruta, K., Mirza, J. (2012). "Evaluation of high-performance concrete properties," Construction and Building Materials, vol. 31, pp. 67-73.

(Continued)

*Primary Examiner* — Carib A Oquendo

(57) ABSTRACT

The porous displacement piles comprising (a) closed-ended pipe piles with small holes and or narrow slots, filled with compacted sandy soil, (b) closed-ended porous pipe piles such as closed-ended pipe pile with very small holes and or very narrow slots, and (c) a precast prestressed porous concrete piles are driven through inside the already driven non-displacement hollow pipe piles in a grid pattern to create excess pore-water pressures generally ranging between 50 and 1500 kPa in cohesive soils, which begin dissipating through inside the porous displacement piles to rapidly consolidate and densify the said cohesive soil. The porous displacement piles are designed for permitting free flow of the pressurized pore-water and to prevent migration of particles of cohesive soil into the porous displacement pile using filter design criteria or verified by laboratory tests. These piles when driven in sandy soils densify sandy soils instantaneously.

7 Claims, 9 Drawing Sheets

Figure 1A:
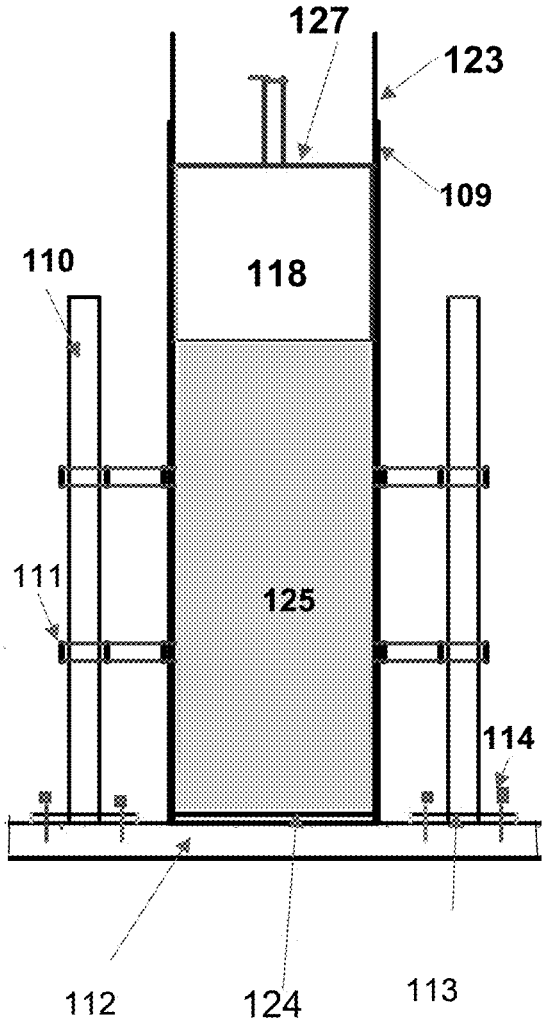

(51) Int. Cl.
*E02D 3/08* (2006.01)
*E02D 7/02* (2006.01)

(58) Field of Classification Search
CPC ..... E02D 27/32; E02D 3/106; E02D 7/02; E02D 2200/1685; E02D 2250/0023
See application file for complete search history.

(56) References Cited

U.S. PATENT DOCUMENTS

| | | | | |
|---|---|---|---|---|
| 9,816,245 | B2 * | 11/2017 | Reinhardt | E02D 5/36 |
| 10,640,945 | B1 * | 5/2020 | Niroumand | E02D 5/44 |
| 2008/0193223 | A1 * | 8/2008 | Wissmann | E02D 5/385 405/232 |
| 2013/0051927 | A1 * | 2/2013 | Kruse | E02D 27/32 405/232 |
| 2015/0330051 | A1 | 11/2015 | White | |
| 2016/0312430 | A1 * | 10/2016 | Wissmann | E02D 5/44 |

OTHER PUBLICATIONS

Jamiolkowski, M., Lancellotta, R., and Pepe, C. (1993) "Leaning Tower of Pisa-Updated Information" , Proceedings, Third International Conference on Case Histories in Geotechnic.

Kennedy, G.D., and Woods, K.B. (1954). "Vertical Sand Drains," Highway Research Board, Bulletin 90, Washington, D.C., USA.

Pabst,M, McDaniel, T, Nuss, L.K., Knight,K, and Pimley, L. (2011)."Embankment Dams, Design Standards No. 13, Chapter 5: Protective Filters," Bureau of Reclamation, U.S. Depart.

Peuchen, J., Berghes, J.F.V., and Coulais, C. (2010), "Estimation of u1/u2 conversion factor for piezocone," Second International Symposium on Cone Penetration Testing, Califo.

Pitt, J. M., White, D.J., Gaul, A., and Hoevelkamp, K . (2003). "Highway Applications for Rammed Aggregate Piers in Iowa Soils," Iowa Highway Research Board, Ames, Iowa, USA.

Prakash, D. and Gupta, R. C. (1972), "Laboratory Studies on Filter Materials Placed at Ramganga Main Dam," Indian Geotechnical Journal, vol. 2, No. 3, Jul. 1972, pp. 203-219.

Schaefer, V.R., Berg, R.R., Collin, J.G., Christofer, B.R., DiMaggio. J.A., J,A, Filz, G.M., Bruce,D.A., and Ayala, D. (2016). "Ground Modification Methods—Reference Manual".

Seed, H. B., and Idriss, I.M. (1971) "Simplified Procedure for Evaluating Soil Liquefaction Potential" , JSMFD, ASCE, vol. 97, SM 9, Sept., pp. 1249-1273.

Shaikh, A.F., and Branson, D.E. (1970). Non-tensioned Steel in prestressed concrete beams, P.C.I. Journal, Precast/Prestressed Concrete Institute, Chicago, Illinois.

* cited by examiner

POROUS DISPLACEMENT PILES MEETING FILTER DESIGN CRITERIA FOR RAPID CONSOLIDATION AND DENSIFICATION OF SUBSURFACE SOILS AND INTERMEDIATE GEOMATERIALS

(1) TECHNICAL FIELD

This application is for applying for a utility patent in a technical field which includes civil engineering and geotechnical engineering for deep densification of layers of soils and intermediate geomaterials in a soil deposit. This specification/description is complete-in-itself. This invention is not sponsored or supported by federally sponsored research or development or by any other organization. The inventor, Dr. Ramesh Chandra Gupta is the sole inventor who has developed this invention and he is a Citizen of the United States of America.

(2) BACKGROUND OF INVENTION

A displacement pile when driven in partially or 100 percent saturated cohesive soil such as silty or clayey soil, displaces soil and creates excess pore-air and pore-water pressures. To consolidate and densify the cohesive soil, these excess pore pressures are to be dissipated through the displacement pile to the ground surface or to a sandwiched sandy layer. Therefore, the displacement piles to act as a means to dissipate excess pore-water or pore-air pressures have to be porous in characteristics. When rain water flows on the ground, it carries with it fine particles of soil, particularly silt and clay particles, which can be seen in muddy and brownish water in rivers on onset of rains. Similarly, when excess pore-water to dissipate excess pore-water pressures flows from the cohesive soil to and through the porous displacement pile, it shall have a tendency to carry fine particles of silty and clayey soil, which are needed to be prevented by the porous displacement pile to act as a fully displacement pile. To have that capacity, the porous displacement pile has to meet a protective filter design criterion which can permit free flow of water, but at the same time, prevent migration of fine particles of soil into the porous displacement piles. It is for these multiple purposes, porous displacement piles comprising (i) closed-ended pipe piles with holes in a specified grid pattern and sandy soil filled in layers and each layer compacted in the pipe section above ground to attain specified density, (ii) closed-ended pipe piles with very small holes in a specified grid pattern, and (iii) porous prestressed concrete piles in a specified grid pattern, with the requirement that all of them shall meet the protective filter design criteria, have been invented and presented in this application to consolidate and densify the subsurface layers of cohesive soils and intermediate geomaterials. First a non-displacement consisting of a hollow pipe section is driven into ground to some depth. To prevent any possibility of heaving of the soil at the ground surface during driving of displacement piles, the porous displacement piles are driven through inside the non-displacement piles. The main inventive step of this invention is that for a displacement pile to perform primary function of rapid consolidation and densification of silty clayey soils is that a displacement pile creates excess pore-water pressures and then densification of sandy or silty clayey soil can occur only when pressurized pore water dissipates through a displacement pile which is porous and allows free flow of water and also prevents migration of fine particles of in-situ into and through the displacement pile to exit either to the ground surface or to sandy player and does not let it to be plugged by fine particles. It may be noted that all these types of piles can also be used to densify subsurface layers of sandy soils.

(3) TECHNICAL PROBLEMS WITH EXISTING METHODS FOR DENSIFICATION OF SUBSURFACE LAYERS (i) Sand drains: A circular casing or mandrel is driven vertically into a soft clayey layer to the required depth. The soil in the casing or mandrel is removed and the hole is backfilled with clean sand under gravity to form a loose layer of sand column in the surrounding weak clayey soil (Kennedy and Woods, 1954). The mandrel or casing is then removed by pulling it out of the ground. The embankment is then constructed on top of the ground surface up to the full height in stages. After allowing sufficient time for consolidation, to dissipate the developed excess pore pressures generally up to 90% consolidation, either embankment if it is for highway left in place or otherwise the embankment is excavated and the required structure is constructed on original ground or at some depth below the original ground. The time for consolidation could vary from six months to a year or more. Recently, PVC drains or wick drains have generally replaced the sand drains.

(ii) Mars (1978) method was developed to compact an area of soil having initial low bearing strength, such as an alluvial or sandy area or an area of hydraulic fill. Mars (1978) introduced another method in which a probe pipe with a partially openable valve in a form of two halves of a cone at its end is driven by a vibratory probe, assisted by liquid jets to erode the in-situ soils around and below the probe and to facilitate its penetration to the design depth. Vibratory probe is very light in weight with very low centrifugal force, and therefore, either pre-augering or liquid jets to erode the soil is required. Liquid jet pipes are the integral part of the probe pipe which pass through at the end of the probe pipe into the in-situ soil. The probe has bands around it at some spacing vertically. When the probe pipe is being penetrated in to the ground, the end valve remains in closed position, and the pebbles, stones etc. are filled in the probe pipe by gravity through a chute achieving a very loose density. When the probe pipe is pulled out of the ground, the partially openable valve opens and allows the pebbles, stones or sand drop through its narrow opening which appears to be less than 25% inside area of the probe pipe, thus forming a column of pebbles, stones etc. with its area of cross-section less than 25% inside area of the probe pipe, because before additional pebbles etc. drop in, in the remaining outside area of probe pipe and bands, the in-situ soil consisting of either soft clay or loose sand will quickly run and cave-in. Therefore, the pebbles etc. dropped under gravity will only be able to form a column in very loose condition with the area of cross-section significantly smaller than the inside area or outside area of the probe pipe. In the opinion of the inventor, this method may loosen the subsurface soils rather than densifying them.

(iii) White (2015) presented an alternative which included an extensible shell made of HDPE with slots of width ¼ inch (6.35 mm) to ⅜" inch (9.53 mm) wide spaced every 6 inches (152 mm); these slots started generally about 1.5 foot (0.46 m) from the top and bottom. The slotted extensible shell was driven using an extractable mandrel attached to a high frequency vibratory hammer into soft clay to a shallow depth of 11 feet (3.4 m) at a test site in Iowa. After which, the mandrel was removed and the extensible shell which was already driven into the ground, was then filled with aggregate consisting of sand in four lifts; each lift consisted of about 7.4 cubic feet (0.2 cubic meters) in volume. Each lift was compacted with the downward pressure and vibratory energy of the extractable mandrel After placement and compaction of aggregate within the extensible shell, the top of the shell was situated at about 1.5 feet (0.46 m) below the ground surface. The shells are of taper shape having a hexagonal cross-section and that tapered downward from an outside diameter of 585 mm (23 inches) at top of the shell to a diameter of 460 mm (18 inches) at the bottom of the shell. It is very likely that while driving the extensible shell in to soft clay to a depth shallow depth of 11 feet (3.35 m), the clay particles of Iowa soft clay will enter into extensible shell through ¼" (6.35 mm) to ⅜" (11 mm) slots, making the extensible shell non-displacement pile. During compaction of sand in 4 layers in the slotted extensible shell, the sand shall first get mixed with clay which entered in the shell during driving and then flow out through the slots in to clay, because maximum particle size of sand is 3/16" (4.75 mm), whereas the widths of slots are ¼' to ⅜" (6.35 to 11 mm). The soft clay is likely to heave to the surface during driving of this large size extensible shell or may flow outwards side-ways like mud flow. Therefore, no excess pore-water pressure could develop in very soft clay in such situations. Particle size distribution of sand was not designed to meet protective filter design criteria, and therefore, excess pore-water pressures, although not likely to develop, but if any at all developed, will result in fine particles of clay to enter in the shell and in the sand filled in shell, making the sand inside the slotted extensible shell an impervious drain. Also, because of mixing of clay in to sand, the pile would not function as a porous pile. Extensible shell can only be driven to shallow depths in soft clay and in other types of soils, the driving stresses even in shallow depths shall exceed allowable stresses and therefore, will crack and break the extensible shell. The extensible shell with slots was not driven through the hollow pipe section to prevent heave or mud flow type characteristics or outward side flow of very soft clay.

My invention presented in this application is for porous displacement piles comprising pipe sections with holes and filled by sandy soils in layers and each layer compacted above the ground surface to a specified relative density, before driving it into ground. The compacted sandy soils conformed to the protective filter design criteria. The closed-ended pipe pile with small holes is to be checked by wave Equation Analyses for allowable driving stresses in the pipe section before selecting them to drive it using a selected hammer in a particular soil type of varying densities. The holes in the pipe shall be small so that pre-compacted sandy soils remain intact the pipe sections, while driving into the ground. A non-displacement pile comprising a hollow pipe section shall be driven first and then porous displacement pile shall be driven through the non-displacement pile, to prevent or minimize any heave of the clayey soil to the ground surface. Therefore, the novelty of my invention of porous displacement piles comprising of pipe sections with small holes and filled and pre-compacted sandy soil above the ground surface and conforming to protective filter criteria and driving stresses not exceeding driving stresses checked wave equation analyses, does not get affected by defective test method of White (2015), because invention of White (2015) does not teach what my invention teaches.

To summarize, White (2015) (i) does not teach that the sand is filled and compacted in layers in the porous pipe/shell above the ground surface, (ii) does not teach that the sand is to be designed to meet protective filter design criteria to provide free flow of pressurized excess-pore water to dissipate excess pore-water pressures and not let fine particles of clayey soil to migrate and get plugged into sand filled in the pipe, (iii) does not teach that the holes or slots provided in the pipe/shell shall not let the sand flow out of the pipe/shell during filling or compaction or during driving into ground, (iv) does not teach that the pipe/shell shall be checked by running wave equation analyses for not exceeding driving stresses for the selected driving hammer to penetrate in in-situ soil conditions, (v) does not teach that the pipe/shell with holes and filled by compacted sandy soil can be used to consolidate and densify the loose to dense sandy soils and consolidate and densify the soft to very stiff soils further and (iv) does not teach that the system of extensible can be driven to deep depths to consolidate and densify soft, stiff and very stiff clayey soils. Therefore, White (2015) can not affect the novelty of my invention presented in this application, which shall accomplish all above objectives with the use of porous pipe piles with holes and filled by sand compacted in layers above ground conforming to protective filter design criteria. Fundamentally, no pile can consolidate and densify a cohesive soil, if it does not have filtration capacity to allow free flow of water through inside it and prevent migration of in-situ soil particles into it. The extensible shell of White (2015) are not designed to provide filtration capacity. White (2015) does not teach what claims 1-3 in my invention as explained in this application teaches.

(iv) LI NUSU (2003) in his dissertation describes a method for pervious concrete ground improvement piles which is different from granular piles such as compaction piles, stone columns and rammed aggregate piles. All these types of piles are cast-in-place. LI NUSU used a method to simulate cast-in-place pervious concrete piles in the laboratory by first raining and depositing soil in the two soil boxes. For installation of pervious concrete piles, a hollow mandrel was used and vibrated into soil using an attached concrete vibrator. During mandrel advancement, the cone tip at the mandrel remains closed. Once the desired depth was achieved, the pervious concrete was placed inside the mandrel from the top. The mandrel is lifted upward at a slow rate. During the mandrel retrieval stage, the cone tip opens and the pervious concrete fills the created space. In test units 3 and 4, the strain gages were hung on a single No. 4 (12.7 mm diameter) rebar and placed at the center of pile cross-section. The pervious concrete pile cast-in-place in the soil, was unreinforced pervious concrete pile (i.e., plane concrete pile) as no reinforcing cage with longitudinal reinforcement rebar (at least four reinforcing rebar in the cross-section) surrounding by lateral ties or spiral reinforcement around the longitudinal reinforcing rebars were provided. The gravel size used in the cast-in-place pervious concrete piles 9.5-4.75 mm (⅜-3/16"), with sand aggregate ratio of 0.07 or 0.11, mixed at water/cement ratio of 0.26, 343 Kg/m$^3$ cement, AEA and HRWR, developing compressive strength between 10 and 15 MPA (his FIG. 2.5), 13 to 19 MPa (his FIGS. 2.6), and 15 to 30 MPa (his FIG. 2.8), and porosity between 0.05 and 0.20. Such a wide range of variation, both in compressive strength and porosity first during preparation of pervious concrete shall increase even further during placing the concrete by partially openable conical valve through the mandrel in clayey soil. The likelihood of clayey soil entering through the conical valve of the mandrel in the field shall be much more, making the concrete impervious, making the whole method defective. LI NUSU described a method for cast-in-place plain pervious concrete piles, by using a mandrel driven into soil. LI NUSU does not teach that his pervious concrete shall allow free flow of pressurized pore-water through inside these pervious piles and shall prevent migration of in-situ particles into these pervious piles. LI NUSU does not teach application of precast prestressed porous concrete piles, driven into ground with filtration capacity to allow free flow of pressurized pore-water through inside these precast prestressed porous concrete piles and shall prevent migration of in-situ particles into these precast prestressed porous concrete piles. LI NUSU does not teach how to perform filtration tests in the laboratory for these porous concrete piles. Li NUSU does not teach what claims 7-10 in my invention as explained in this application teaches. The invention in my application is for precast prestressed porous concrete piles, therefore, LI NUSU's dissertation does not affect the novelty of my application.

(v) Buildings, walls, industrial facilities, and transportation-related structures typically consist of shallow foundations, such as spread footings, or deep foundations, such as driven pilings or drilled shafts. Shallow foundations are much less costly to construct than deep foundations. When shallow foundations cannot provide adequate bearing capacity to support building weight with tolerable settlements, deep foundations are generally used. Various types of piles, such as HP-piles, pipe piles, step-tapered piles, monotubes, micropiles, and concrete filled closed ended pipe piles, etc., have been used in the industry to support footings of the structures. Ground improvement techniques (Schaefer et. al., 2016) such as deep dynamic compaction and vibro-floatation to compact sandy soils, jet grouting, soil mixing, stone columns, and aggregate columns (Pitt et. al., 2003) have been used to improve soil sufficiently to allow for the use of shallow foundations. The vibro-floatation or stone column equipment has frequency of 3000 rpm, centrifugal force of 30000 kg, weight of 9000 kg, height of about 2.5 meter, and inside diameter of about 38 cm. The vibro-floatation and stone column vibro-equipment has a central hole through which water jets are jetted to erode soil when subsurface soil conditions are such that vibration alone cannot penetrate into soil any further or when penetration rate becomes very slow. Cement-based systems such as grouting or mixing methods such cement or lime-soil mixed columns have been used to carry heavy loads and also to support highway embankments, retaining walls and slopes but remain relatively very costly. Stone columns and aggregate columns (Shaefer et al., 2016) have been used to support highway embankments, bridge abutments etc., but are relative costly and limited by the load bearing capacity of the columns in soft clay soil. All these methods, i.e., jet grouting, soil mixing, stone and aggregate columns, cement or lime-soil mixed columns, extensible tapered shells in very soft clays, installing HP columns, then sandwiched layers sand between geotextiles/geogrids to support highway embankments, do not consolidate and densify subsurface layers of very soft, soft, stiff, very stiff and stiff clayey soils, but provide reinforcement or columns to support the spread footings of various structures or to support embankments and remain very costly. Therefore, there is a great need to develop a deep densification and consolidation technique to rapidly consolidate and densify subsurface clayey soils. The invention presented in this application, achieves successfully this objective by use of porous displacement piles meeting the protective filter design criteria. In most or many cases, this this invention will generally require readily available instruments and machinery such as cranes and pile driving hammers etc., pullers, surface or plate vibrators, which could be available on rent or for leasing at most places or for sale from manufacturers.

(4) SUMMARY OF INVENTION

(a) Solution to Problem and Advantageous Effects of Invention

As explained above, the rapid consolidation and densification method is installed to increase the density of both sandy and clayey materials. The porous displacement piles shall densify the (i) very soft to soft cohesive soil to stiff or very stiff cohesive soil, (ii) medium stiff cohesive soil to stiff or very stiff cohesive soil, (iii) stiff cohesive soil to very stiff cohesive soil, and (iv) very stiff cohesive soil to hard or very hard soil cohesive soil, depending on the selected spacing between the adjoining porous displacement piles. Similarly, the porous displacement piles shall compact sandy soil from (i) very loose (relative density less than 15%) to medium dense (relative density between 35 and 65%), (ii) loose (relative density between 15 and 35%) to medium or dense sand (relative density between 65 and 85%), (iii) from medium dense to dense sand, and (iv) from dense to very dense (relative density greater than 85%), depending on the selected spacing between the adjoining porous displacement piles. Both the densified in-situ clayey silty soil and in-situ sandy soil in a layer to the selected depth below ground surface shall be capable of providing support to the foundation of a structure with adequate bearing capacity and minimum settlements. During construction of the structure on densified in-situ soil, if any excess pore-water pressure develops, shall quickly dissipate and small settlement shall occur before the structure reaches full height. No embankment as required for the sand drains or PVC drains and waiting for consolidation to occur for 6 months to more than a year shall be needed when the rapid consolidation and densification method is selected. Therefore, progress of construction shall become very fast, which is very important for highway projects for expansion or widening of existing roads and highways or also for support of the foundations of various structures.

(5) BRIEF DESCRIPTION OF INVENTION

A displacement pile when driven in partially or 100 percent saturated cohesive soil such as silty or clayey soil, displaces soil and creates excess pore-air and pore-water pressures. To consolidate and densify the cohesive soil, these excess pore pressures are to be dissipated through the displacement pile to the ground surface or to a sandwiched sandy layer. Therefore, the displacement piles to act as a means to dissipate excess pore-water or pore-air pressures have to be porous in characteristics. When rain water flows on the ground, it carries with it fine particles of soil, particularly silt and clay particles, which can be seen in brown color water in rivers during the onset of rains. Similarly, when excess pore-water to dissipate excess pore-water pressures flows from the cohesive soil to and through the porous displacement pile, it shall have a tendency to carry fine particles of silty and clayey soil, which are needed to be prevented by the porous displacement pile to act as a fully displacement pile. To have that capacity, the porous displacement pile has to meet a protective filter design criterion which can permit free flow of water, but at the same time, prevent migration of fine particles of soil into the porous displacement piles. It is for these multiple purposes, porous displacement piles comprising (i) closed-ended pipe piles with holes in a specified grid pattern and sandy soil filled in layers and each layer compacted in the pipe section above ground to attain specified density, (ii) closed-ended pipe piles with very small holes, and (iii) porous prestressed concrete piles, with the requirement that all of them shall meet the protective filter design criteria, have been invented and presented in this application to consolidate and densify the subsurface layers of cohesive soils and intermediate geomaterials. First a non-displacement consisting of a hollow pipe section is driven into ground to some depth. To prevent heaving of the soil at the ground surface during driving of displacement piles, the porous displacement piles are driven through inside the non-displacement piles to the depth up to which densification of subsurface layers is required. All these types of piles can also be used to densify subsurface layers of sandy soils.

There is one more type of displacement pile which consists of the pipe sections with a removable end plate, in which sandy soil is filled in layers and each layer is compacted to a specified density above ground and then the said pipe section is driven through a non-displacement pile, (which has been first driven to some depth in the ground) to the depths up to which the subsurface layers are to be densified. Then a heavy weight is placed in the pipe section and the pipe section is pulled out of the ground leaving behind a column of compacted sandy soil and the removable end plate in the ground. The column of compacted sandy soil left into the ground up the design depth behaves as a porous displacement pile. The particle size distribution of the column of the compacted sandy soil must meet protective filter design criteria. The inventor and applicant of today's application has already received an US patent No. U.S. Ser. No. 10/844,568B1 for the above type porous displacement pile, based on the original application Ser. No. 16/909,581. This application is CIP of application Ser. No. 17/090,858, CIP of application Ser. No. 17/075,244, which is a CIP of original application Ser. No. 16/909,581.

(6) BRIEF DESCRIPTION OF THE SEVERAL VIEWS OF THE DRAWING

FIG. 1A: A setup for providing lateral support to a closed-pipe section (123) with holes in the pipe section placed inside another pipe section (109) during densification of the sandy material in it (Note: small holes in the pipe-section (123) not shown in this figure).

Figure 1B:
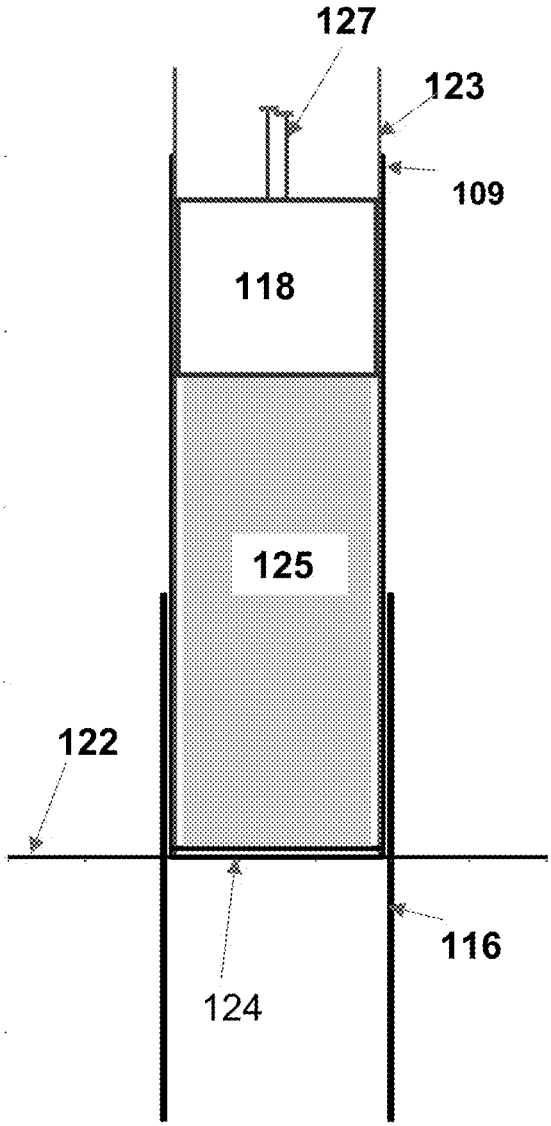

FIG. 1B: Another setup for providing lateral support to the closed-ended pipe section (123) with holes in the pipe section placed inside another pipe section (109) during densification of the sandy material in it (Note: small holes in the pipe-section (123) not shown in this figure).

Figure 2A:
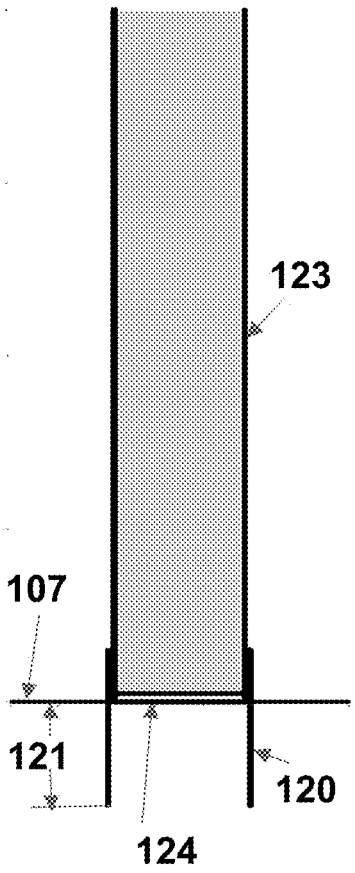

FIG. 2A: A field setup for first installing a non-displacement pile (120) and then placing the closed-ended pipe section (123) with small holes in the pipe section filled with compacted sandy material on ground for driving it into to ground (Note: small holes in the pipe-section (123) not shown in this figure).

Figure 2B:
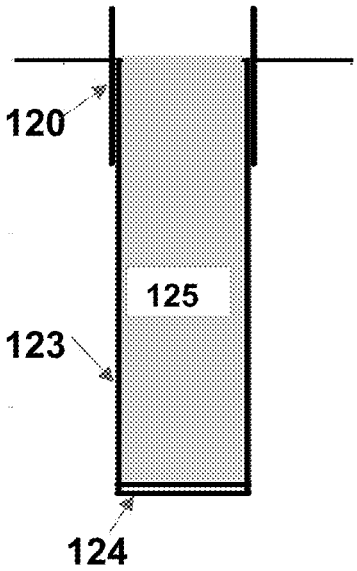

FIG. 2B: The closed-ended pipe section (123) with small holes in the pipe section filled with compacted sandy material driven to design depth (Note: small holes in the pipe-section (123) not shown in this figure).

Figure 2C:
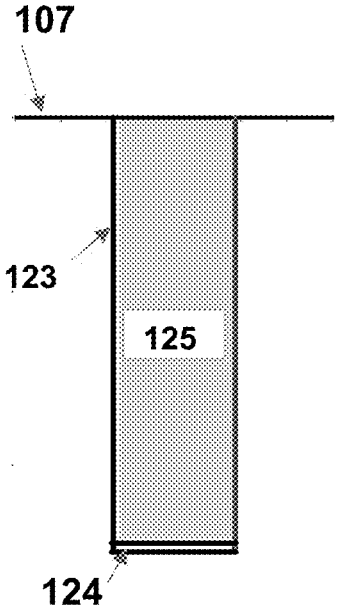

FIG. 2C: A porous displacement pile comprising the closed-ended pipe section (123) with small holes filled with compacted sandy material in place in the ground after pulling out the non-displacement pile (Note: small holes in the pipe-section (123) not shown in this figure).

Figure 3A:
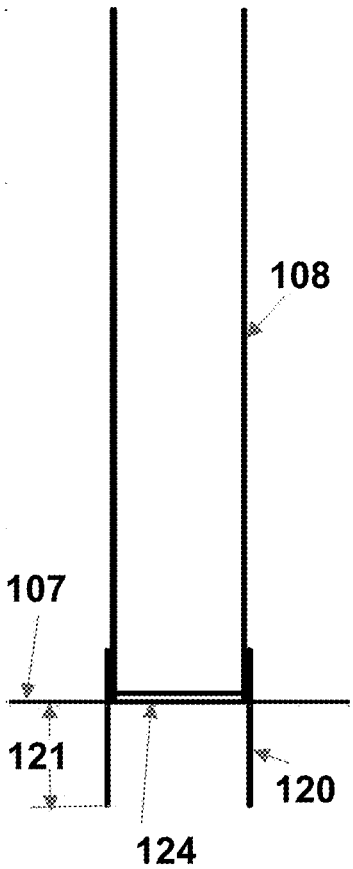

FIG. 3A: A setup for first installing a non-displacement pile (108) and then placing the closed-ended pipe section (108) with very small holes in the pipe section on ground for driving into ground (Note: very holes in the pipe-section (108) not shown in this figure).

Figure 3B:
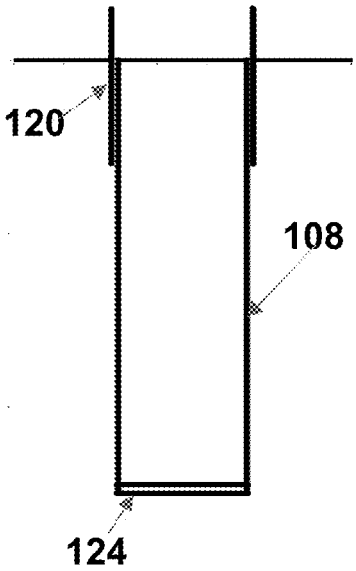

FIG. 3B: The closed-ended pipe section (108) with very small holes in the pipe section driven to a design depth (Note: very small holes in the pipe-section (108) not shown in this figure).

Figure 3C:
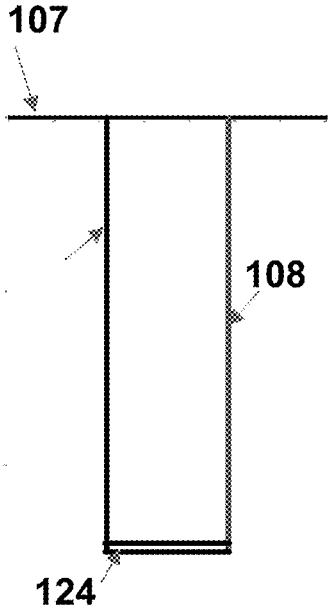

FIG. 3C: A porous displacement pile comprising the closed-ended pipe section (108) with very small holes in the pipe section in-place in the ground after pulling out the non-displacement pile (Note: very small holes in the pipe-section (108) not shown in this figure).

Figure 4A:
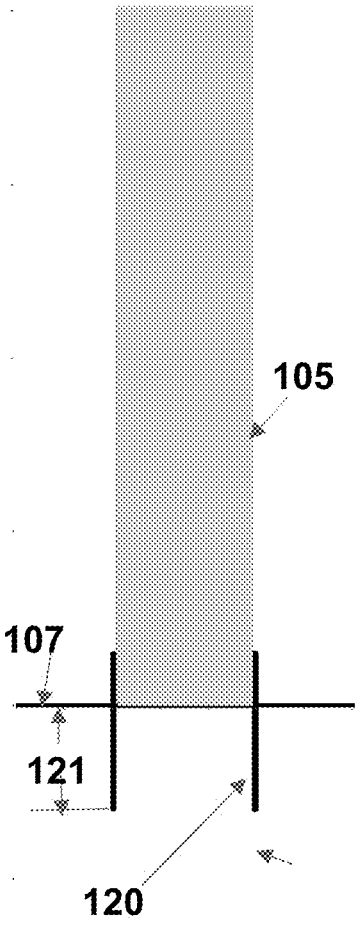

FIG. 4A: A setup for first installing a non-displacement pile (120) and then placing the precast prestressed porous concrete pile on ground for driving into ground.

Figure 4B:
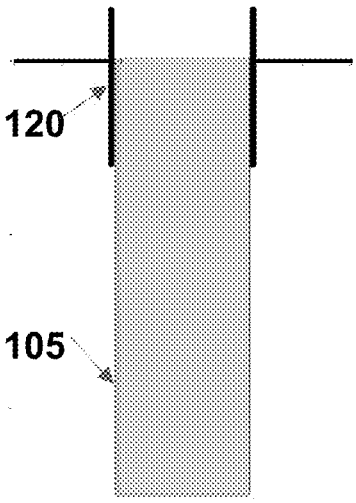

FIG. 4B: The precast prestressed porous concrete pile driven to a design depth.

Figure 4C:
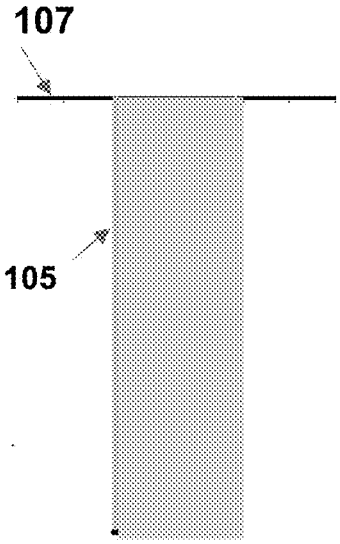

FIG. 4C: A porous displacement pile comprising the precast prestressed porous concrete pile in-place in the ground after pulling out the non-displacement pile.

Figure 5:
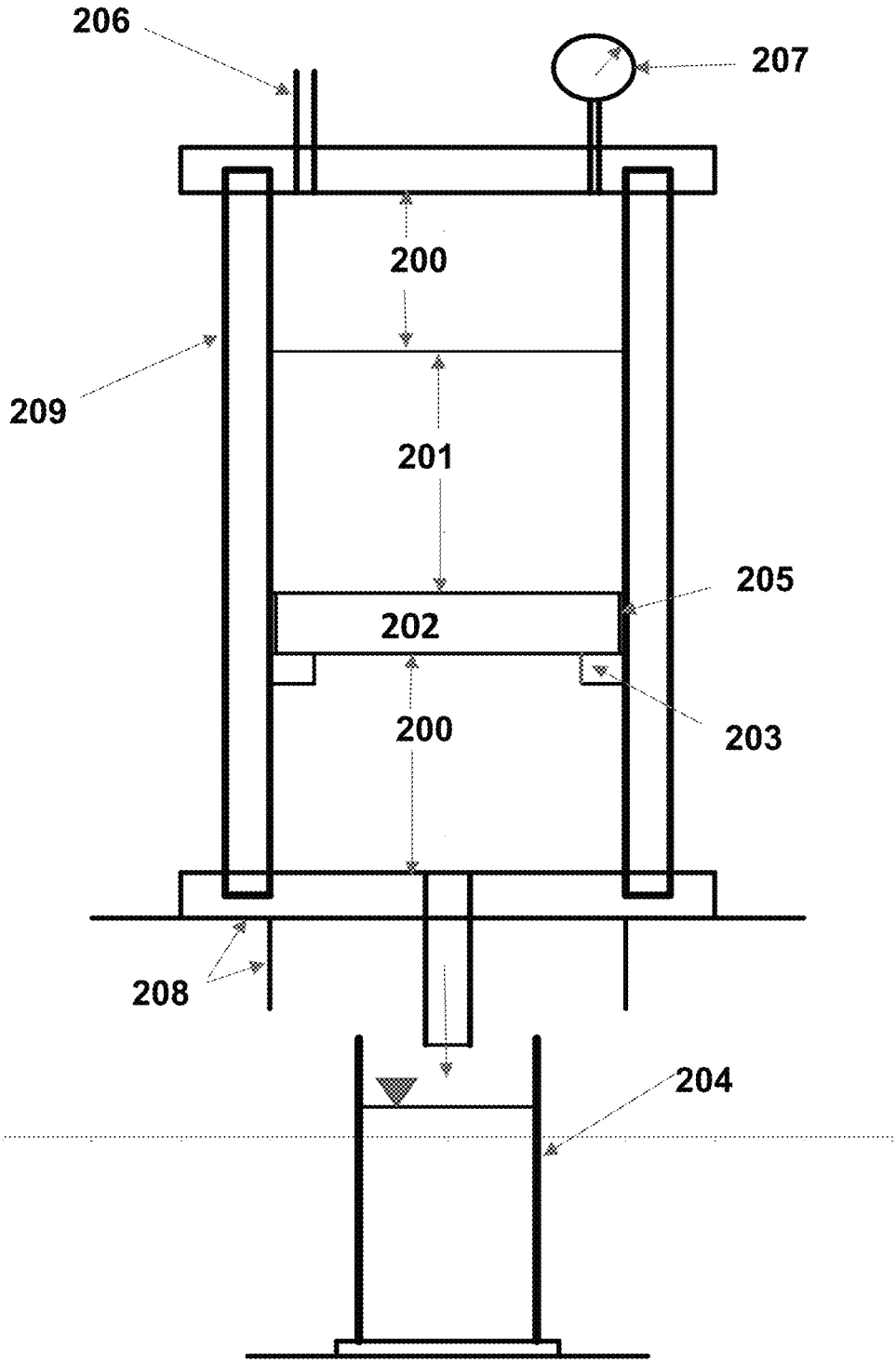

FIG. 5: Schematic detail for laboratory test for determining filtration Capacity of porous plate with very small holes/very narrow slots or Porous Concrete Plate.

Figure 6A:
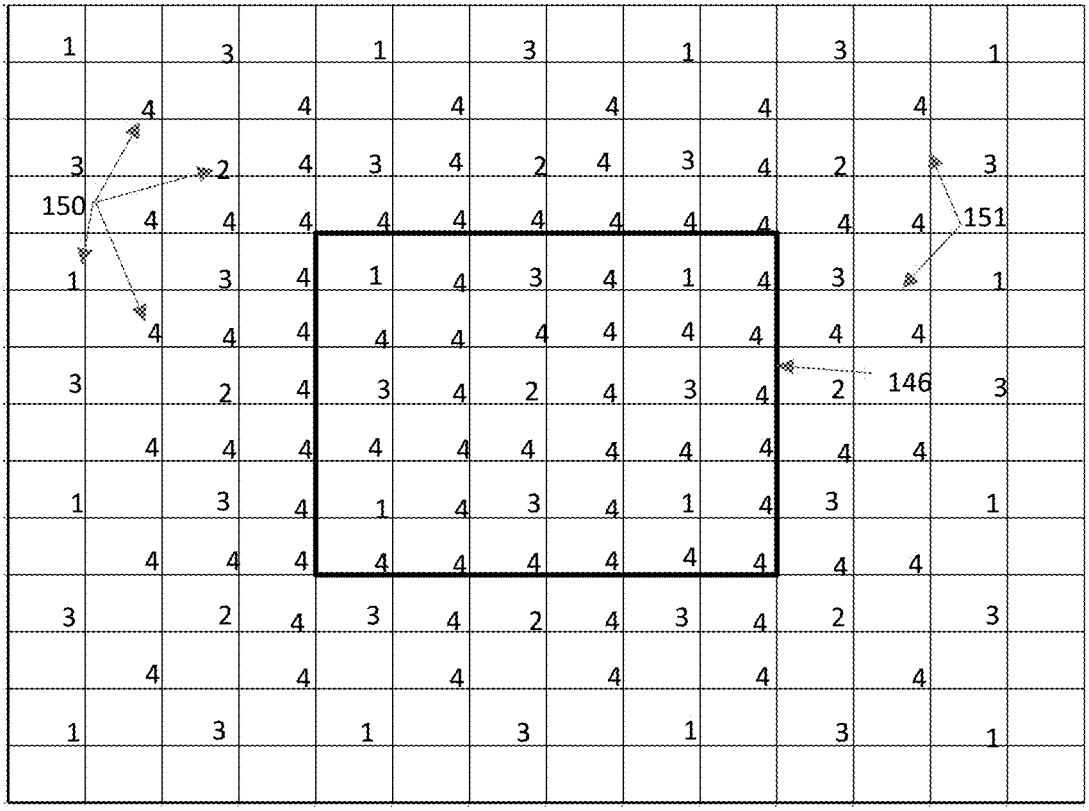

FIG. 6A: A typical plan showing the grid lines (151) and the locations (150) of porous displacement piles for soil improvement under a spread footing.

Figure 6B:
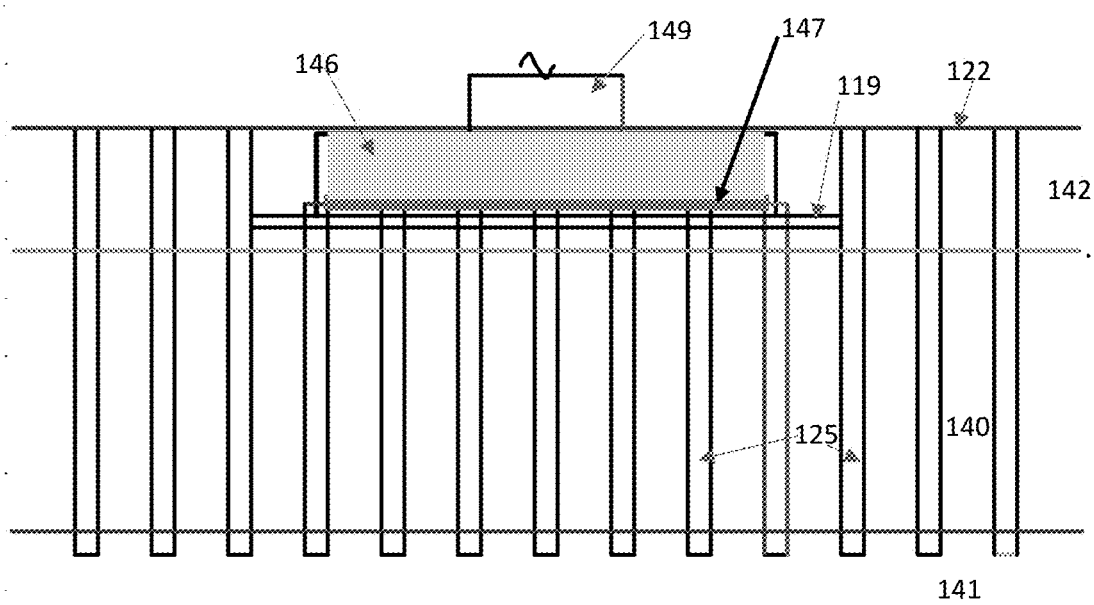

FIG. 6B: Sectional elevation showing the installed porous displacement piles (125) under the spread footing.

Figure 7A:
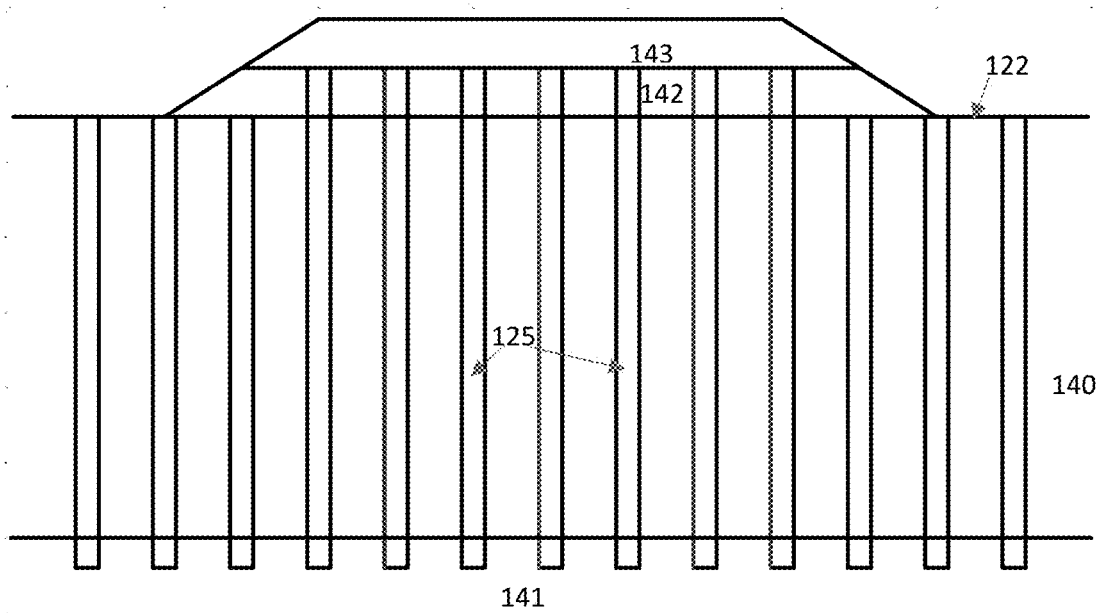

FIG. 7A: A typical detail of the installed porous displacement piles (125) under an embankment.

Figure 7B:
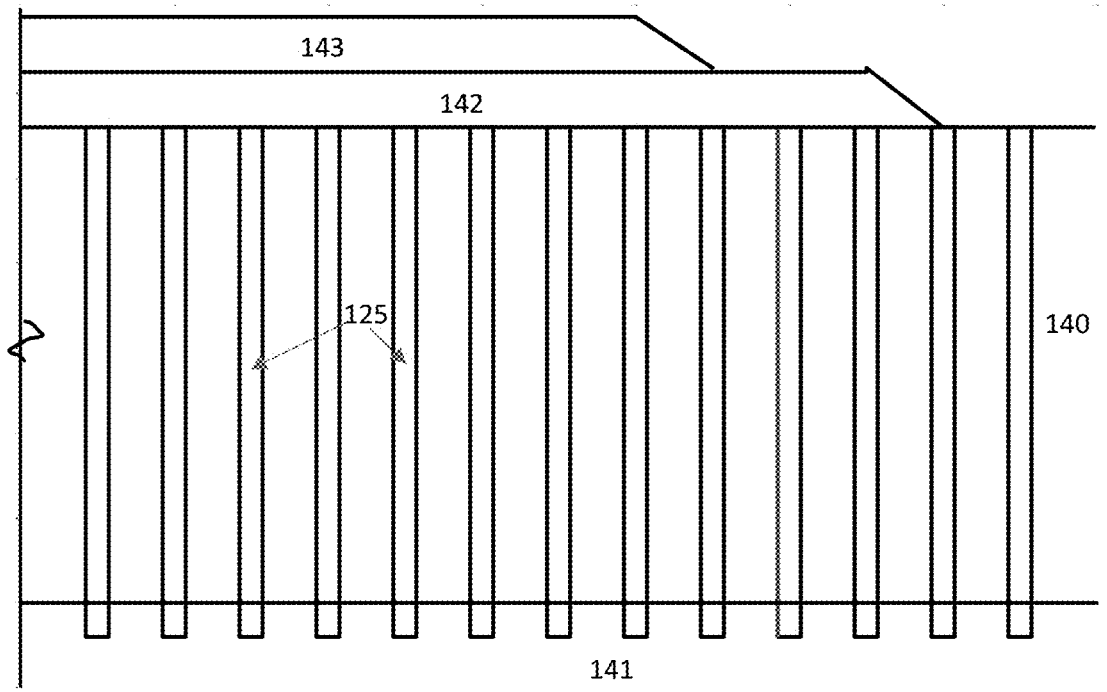

FIG. 7B: A typical detail of the installed porous displacement piles under an embankment with porous displacement piles at primary locations installed ahead of the embankment and the embankment extended on the installed porous displacement piles (125).

Figure 8:
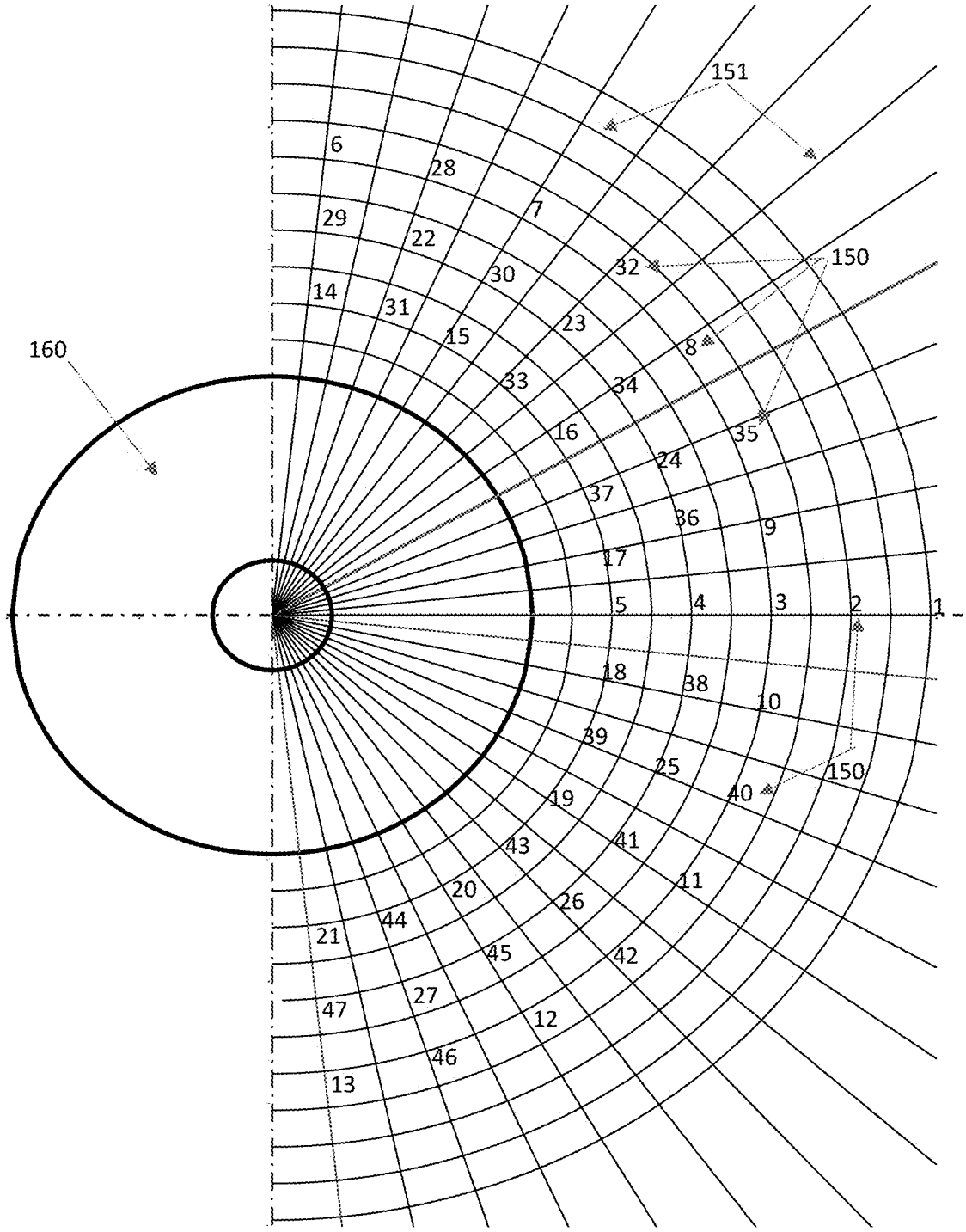

FIG. 8: A typical plan showing the grid lines (151) and the locations (150) of porous displacement piles for soil improvement under and by the side of foundation of the Leaning Tower of Pisa.

Figure 9:
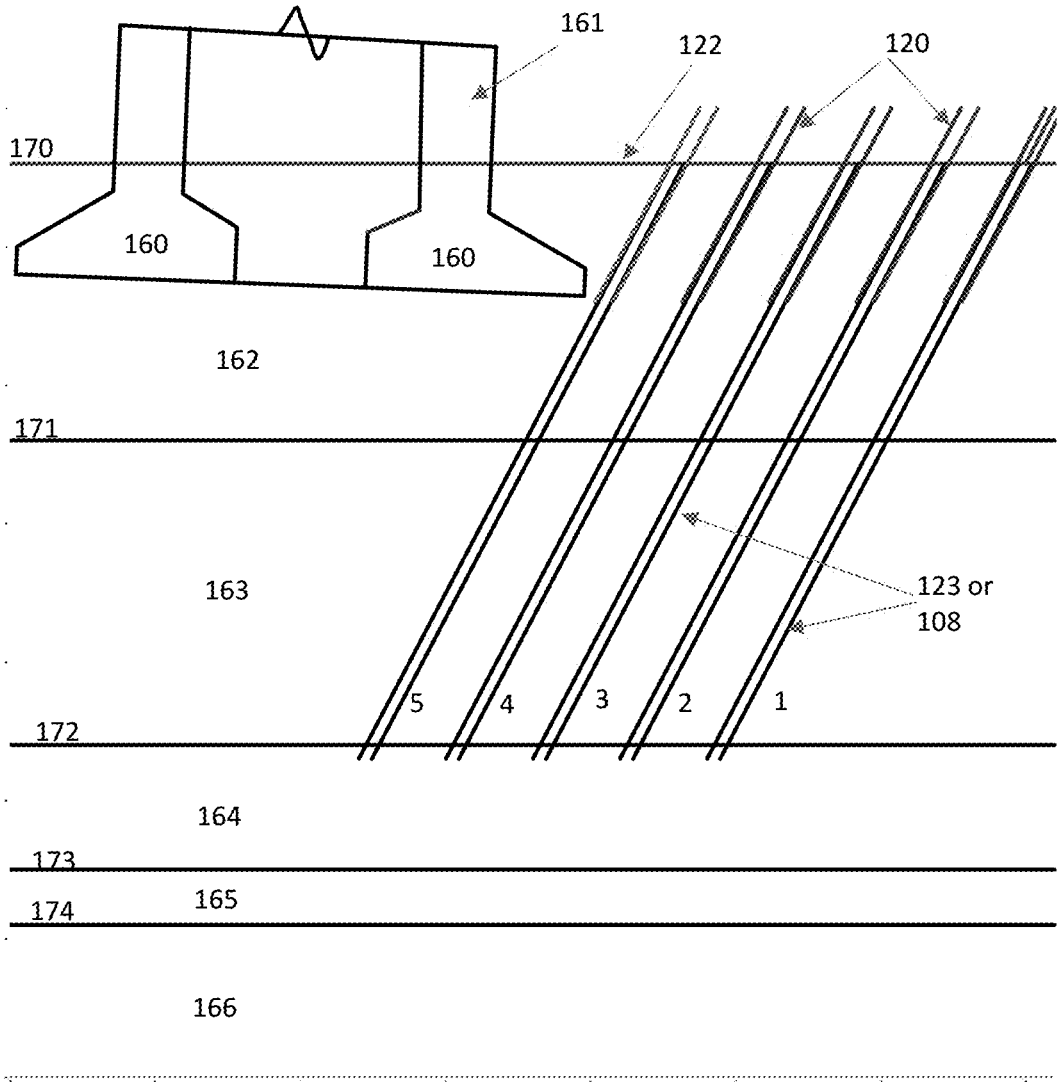

FIG. 9: A typical detail showing foundation of the Leaning Tower of Pisa and subsurface soil layers along with batter Porous Displacement Piles (125).

(7) DETAILED DESCRIPTION OF THE INVENTION

The invention in this application comprises a rapid consolidation and densification method to produce rapid consolidation of the subsurface layers of the very soft, soft to very stiff cohesive soil resulting in increase of its density and consistency and also to densify very loose to dense sandy soils, by use of porous displacement piles. The porous displacement piles comprise of (i) a closed ended porous pipe pile with small holes/slots (123) and filled in layers and each layer compacted to a specified relative density, (ii) a closed ended pipe pile with very small holes/slots, (108) and (iii) a porous precast prestressed concrete pile (105), with the condition that all these types porous displacement piles meet the filtration criteria. According to the filtration criteria or protective filter design criteria, the porous displacement piles shall provide free flow of pressurized pore-water to dissipate excess pore-water pressures through the porous displacement pile and at the same prevent migration of fine particles of in-situ clayey silty soils. To minimize heave of subsurface soils near the ground surface during penetration of porous displacement piles, a non-displacement pile (120) is driven first to some depth (121), and then the porous displacement piles are driven through inside the non-displacement piles. The porous displacement pile when driven in in the clayey silty soils first develops the excess pore-water pressures which then rapidly dissipate accompanied by flow of pressurized pore-water horizontally to the porous displacement pile and then by vertically through the porous displacement pile to the ground surface or to a sandy layer above or below the porous displacement pile. When the porous displacement piles adjoining to the first porous displacement pile in a grid pattern are installed, the length of the drainage path is further reduced to half the spacing between adjoining porous displacement piles, allowing rapid consolidation and densification of the layer of clayey soil which causes increase of its density and consistency sufficiently enough to support loads of the required structure, such as pavement, civil structure, airport or oil storage tank, etc. Installing the porous displacement piles in the layer of loose or medium dense or dense sand layer in a grid pattern results in the instantaneous increase in its density. Therefore, the rapid consolidation and densification method using porous displacement piles presented in this application as an invention, improves and increases the density of all types of soils and intermediate geomaterials to support loads of the structures of a project. The sandy material in closed ended pipe piles with small holes/slots is compacted to relative density equal to relative density equal to either medium dense or dense conditions, above the ground surface prior to driving in to the ground.

During cone penetration, the maximum value of the excess pore-water pressures is around the surface of the cone penetrometer; the excess pore-water pressures rapidly reduce with radial distance from the cone penetrometer. Same trend of excess pore-water distribution around porous displacement piles is expected to occur during penetration of the porous displacement piles. The maximum excess pore-water pressure, which occurs at the face of the porous displacement shall quickly dissipate through the porous displacement pile as the length of the path of flow is zero. When adjoining porous displacement piles are installed, the length of the path for flow shall reduce to half the clear spacing between adjoining porous displacement piles. For example, if the center to center spacing of porous displacement piles is, say for example, 4 times of the radius of the porous displacement piles, then the distance between faces of the porous displacement piles shall be only three times the radius, but from the mid-point between the porous displacement piles shall be only 1.5 times the radius, facilitating very quick dissipation of the excess pore-water pressures.

In an earth dam of 30-meter (98.4 feet) height, excess pore-water pressures to the extent of 42.6 psi (296 kPa) are developed in clay zone and therefore, it is required that the sandy material in chimney filter zone of the earth dam satisfy a filter criterion to prevent migration of fine particles of clayey silty soil and also to allow free flow of the excess pore-water pressures. In view of this, the particle size distribution of the compacted sandy material in the porous displacement piles, will also be designed to satisfy the Terzaghi filter design criteria or other recognized filter design criteria. During cone penetration which also acts like a model displacement pile, values of excess pore-water pressures depend on the consistency and depth of the clay below the ground surface. During cone penetration, pore-water pressures in the range between 250 psi (1746 kPa) and 350 psi (2413 kPa) were recorded in Cooper Marl. Peuchen et al. (2010) recorded excess pore-water pressures in the range between 50 kPa (7.25 psi) and 800 kPa (116 psi) during piezocone penetration in heavily overconsolidated soft to stiff cohesive soil. Therefore, during penetration/driving of the porous displacement piles, the excess pore-water pressures in silty clayey soils are expected to be created equal or greater than those which occur during cone penetration. In view of above, the porous displacement piles to effectively and successfully perform their function of consolidating and densifying silty clayey soils have to satisfy protective filter design criteria.

The closed-ended pipe section/pile (i.e., pipe section with attached end plate at the tip of the pile) with small or very small holes or narrow or very narrow slots could be round, square or rectangular or any shape available or made in the industry. Sometimes, two angle sections or two channel sections welded together could also be used as a hollow pipe section. When the said closed-ended pipe sections/piles are driven in to ground, then for geotechnical purposes, it is called a displacement pile as it displaces the soil by occupying its place. When these sections without any end plate at its bottom (i.e., a hollow section) is driven in to ground then for geotechnical purposes, it is called a non-displacement pile. The non-displacement pile is driven into the ground first, in order to minimize or prevent heave at the ground surface or at the top the layer which is to be densified. Ideally, during driving the displacement pile, there should not be any heave of the ground surface to achieve maximum lateral displacement of the soil by the porous displacement pile, in order to achieve maximum densification. That is why to minimize heave, first a non-displacement pile is driven to selected depth and then the displacement pile is driven through the non-displacement pile. If this step of driving displacement pile through a non-displacement pile is omitted and displacement pile is driven directly, due to economics or for any other reason or when non-displacement pile has not been driven to adequate depth to minimize or prevent heave, then although full densification of in-situ soil may not occur due to some heave at the ground surface, the in-situ test results may indicate that required degree of densification has been achieved. Anyway, in such cases, the amount of densification will be less as the volume of the in-situ soil displaced by the displacement pile will be sum of the reduction of voids in the in-situ soil plus the volume soil which heaved if any, at the ground surface or at the top of the layer to be densified. In certain soil conditions such or soft or very soft silty sandy soil, or silty clays or clays, driving non-displacement piles first then driving porous displacement piles through inside of the non-displacement piles becomes important to prevent mud wave or flow of such said soils sideways around the piles, if this happens no densification may occur. The overburden soil above the depth of the bottom of the non-displacement pile (120) acts to prevent or minimize the heave at the ground surface to a reasonable limit. In most cases, the depth of a non-displacement pile equal between 4 and 7 times the diameter of the porous displacement pile will reasonably reduce or minimize the amount of heave at the ground surface. However, not enough or substantial research is available at the present, to predict the reasonable depth (121) in different types of soils at various densities or consistencies to prevent or minimize the heave at the ground surface when a displacement pile is being driven into the ground. Sufficient research shall be developed to predict the reasonable depth (121) in different types of soils at various densities or consistencies, when the projects involving ground improvement using the porous displacement piles are being implemented. In any case, whether non-displacement has been installed or not installed, the porous displacement must provide free flow of excess pore-water to dissipate excess pore-water pressures and prevent migration of particles of in-situ soil during flow of water in the porous displacement piles.

Filtration Capacity of Porous Displacement Piles

Terzaghi's Criteria is briefly described below:

Piping or Migration of particles criteria: $D_{85(Base)}$ represents the particle size that must be retained. $D_{15(Filter)}$ is representative of average pore size. Filter to trap particle size larger than about 0.1 $D_{15(Filter)}$ $$D_{15\ (filter)} < 4 \text{ to } 5\ D_{85\ (Base)}$$

Permeability or Free Flow Criteria:

$$D_{15\ (filter)} > 4 \text{ to } 5\ D_{15\ (Base)}$$

Gradation Control $$D_{50(filter)} < 25\ D_{50\ (Base)}$$

Sandy material filled layers and each layer compacted to a specified relative density in porous displacement pile comprising the closed-ended pipe pile with small holes works as the filter. In-situ clayey silty soil which surrounds the compacted sandy material of the porous displacement pile, works as the base in the above criteria. $D_{15}$ is the diameter for which 15% of the material by weight is finer and $D_{85}$ is the particle diameter for which 85% of the material by weight is finer. Criteria given in Design Standards 13: Embankmemt Dam (Bureau of Reclamation, 2011) is also a good source for designing protective filters for both gap-graded and well-graded sands. The filtration capacity of sandy materials can also be verified when considered necessary by laboratory tests (Prakash and Gupta, 1972, Bureau of Reclamation, 2011 or otherwise published and accepted laboratory tests), if necessary. When the sandy material is gap graded (some particle sizes missing) then, verification by laboratory tests to verify its filtration capacity may be required.

The filtration capacity of the closed ended pipe piles with very small holes/very narrow-slots and prestressed porous concrete piles shall need to be verified by laboratory tests.

For determining required particle size distribution curve of sandy material to be compacted in the pipe section, it is necessary to determine the particle size distribution of the cohesive soil, from which $D_{15}$, $D_{50}$ and $D_{85}$ sizes of the in-situ cohesive soil are to be determined. After determining $D_{15}$, $D_{50}$ and $D_{85}$ sizes of in-situ cohesive soil which requires densification, the required $D_{15}$ and $D_{50}$ sizes of the sandy soil are to be determined using the protective filter design criteria. The available sandy soil's particle size distribution is then also to be determined, from which its $D_{15}$ and $D_{50}$ sizes are to be determined and then compared with D15 and D50 sizes as described above using the protective filter design criteria. This is the way, it is verified that the available sandy soil meets the protective filter design criteria, before finally selecting the sandy soil for compacting in the pipe section. The year 2011 Bureau of Reclamation's publication on "Embankment Dams, Design Standards No. 13, Chapter 5: Protective Filters is good source as a reference to finalize particle size distribution of sandy soil. There are many text books which also provide the filter design criteria and how to finalize the particle size distribution for the filter or verify the available on-site sandy soil for its adequacy for filter for a particular base soil/in-situ soil layer or layers in which excess pore-water pressures will be developed.

(i) Porous Displacement Pile Comprising of Closed Ended Pipe Piles with small holes or narrow slots and filled with compacted sandy Soils For densification of sandy soil in the closed-ended pipe piles with small holes or narrow slots (or combination of both) in a selected grid pattern, the said closed-ended pipe pile is to be inserted into another pipe section (109) and held vertically with lateral supports using braces (111) and Columns (110) as shown in FIG. 1. Columns are held by bolts (114) and base plate (113) into a rectangular base plate or beam (112) plate. Sandy soils are filled in layers and each layer compacted to the specified relative density in the said closed-ended pipe resting on ground surface (107). The said closed ended pipe pile is attached to an end plate (124). The FIG. 2 as described above has been designed fora particular subsurface condition. This scheme could be revised and redesigned for a different soil condition at a site. If deep densification method is done on a boat or ship (with or without jacked-up supports) then the detail for laterally holding the said pipe for compaction of sand is to be designed after seeing the layout on the boat or ship.

Each layer of the sandy soil (125) is compacted by a specified number of drops of a hammer or a weight (118) to achieve a specified dry density or relative density. The connecting pipe or rod (127) connects the weight or hammer to a boom of crane or to a pile driving hammer system (not shown in the FIG. 1B). Alternatively, either the sandy soil can also be filled in layers and then the hammer or the weight (118) placed on top of each layer, after which vibrated by attaching a surface vibrator on the sides of the pipe section (123) or the vibratory probe/weight is placed on top of each layer for densifying the sandy soil to the specified dry density or relative density. There are many types of (i) hammer/weight available in the industry to drop on the sandy soil placed inside the pipe section (123) for densifying the sandy soil, (ii) surface vibrators available in the industry which can be used around the pipe to densify sand inside the pipe section (123), when the weight or hammer has already been placed on top of the sandy material to compact it, and (iii) the vibrator on top of a plate or vibrating weight available in the industry to densify sandy soil inside the pipe; any of these-said equipment and the required attachments to the connecting rod etc. can be used when considered appropriate according to specifications or brochures of the manufacturers of the equipment or according to industry practice. There are many types of pile driving hammers including vibratory hammers available in the industry to drive a non-displacement or displacement pile; any of these driving hammers with required attachments can be used when considered appropriate according to specifications. The attachments between the pipe section or rod (127) and the crane by U-Bolts or hooks etc., or the surface vibrator to the pipe section (123) or plate vibrators etc. shall be in accordance with the manufacturer's specification and brochure or according to industry practice. When the pipe section is being driven, all attachments of the pile driving hammer shall be in accordance with pile driving specifications and wave equation analyses. Many organizations do not allow vibratory hammers to drive non-displacement or displacement piles in clayey silty soils, because it is considered that vibration remolds and disturbs the matrix and lock-in-stresses of clayey silty soils.

The non-displacement pile is driven into the ground first, in order to minimize or prevent heaving at the ground surface or at the top the layer which is to be densified and the porous displacement pile is driven through inside the non-displacement pile. Ideally, during driving the displacement pile, there should not be any heave of the ground surface to achieve maximum lateral displacement of the soil by the porous displacement pile, in order to achieve maximum densification. That is why to minimize heave, first a non-displacement pile is driven to selected depth and then the displacement pile is driven through the non-displacement pile. If this step of driving displacement pile through a non-displacement pile is omitted and displacement pile is driven directly, due to economics or for any other reason or when non-displacement pile has not been driven to adequate depth to minimize or prevent heave, then although full densification of in-situ soil may not occur due to some heave at the ground surface, the in-situ test results may indicate that required degree of densification in the layer or layers requiring densification has been achieved. Anyway, in such cases, the amount of densification will be less as the volume of the in-situ soil displaced by the displacement pile will be sum of the reduction of voids in the in-situ soil plus the volume soil which heaved if any, at the ground surface or at the top of the layer to be densified. In certain soil conditions such or soft or very soft silty sandy soils, or silty clays or clays, driving non-displacement piles first then driving porous displacement piles through inside of the non-displacement piles becomes important to prevent mud wave or flow of such said soils sideways around the piles, if this happens no densification may occur. The overburden soil above the depth of the bottom of the non-displacement pile (120) acts to prevent or minimize the heave at the ground surface to a reasonable limit. In most cases, the depth of a non-displacement pile equal between 4 and 7 times the diameter of the porous displacement pile or more will reasonably reduce or minimize the amount of heave at the ground surface. However, not enough or substantial research is available at the present, to predict the reasonable depth (121) in different types of soils at various densities or consistencies to prevent or minimize the heave at the ground surface when a displacement pile is being driven into the ground. Sufficient research shall be developed to predict the reasonable depth (121) in different types of soils at various densities or consistencies, when the projects involving ground improvement using the porous displacement piles are being implemented. In any case, whether non-displacement has been installed or not installed, the porous displacement must provide free flow of excess pore-water to dissipate excess pore-water pressures and prevent migration of particles of in-situ soil during flow of water in the porous displacement piles.

The closed ended pipe pile with small holes or slots shall be checked by Wave Equation Analyses (Pile Dynamics, 2005) to verify that the driving stresses are not exceeded in the said pipe pile for the subsurface soil conditions in which the said pile is to be driven by a selected hammer. The compacted sandy soil is to conform to protective filter design criteria of Terzaghi or conform to Bureau of Reclamation protective filter design criteria or conform to any other widely used and recognized/published filter design criteria. If considered necessary, determination of filtration capacity shall be determined using the existing laboratory tests, such as those by Bureau of Reclamation or US Army Corps of Engineer. When the porous displacement piles comprising closed-ended pile with small holes or narrow slots, adjoining to the first porous displacement pile in a grid pattern are installed, the length of the drainage path is further reduced to half the spacing between adjoining porous displacement piles, allowing rapid consolidation and densification of the layer of clayey soil which causes increase of its density and consistency sufficiently enough to support loads of the required structure, such as pavement, civil structure, airport or oil storage tank, etc. Installing the porous displacement piles in the layer of loose or medium dense or dense sand layer in a grid pattern results in the instantaneous increase in its density. Therefore, the rapid consolidation and densification method using porous displacement piles comprising closed-ended piles with small holes or narrow slots, presented in this application as an invention, improves and increases the density of all types of soils and intermediate geomaterials to support loads of the structures of a project. As already stated, the sandy material in closed ended pipe piles with small holes or narrow slots is compacted to relative density equal to relative density equal to either medium dense or dense conditions. During driving the closed-ended pipe piles with small holes or narrow slots shall be sufficiently small so that during driving the said pile into the ground, the compacted sandy soil shall not spill out from the said pile. When being driven in to the ground, the compacted sand in the portion of the said pile already in the ground shall not allow any intrusion of fine particles of the in-situ soil. The porous displacement piles comprising the closed ended pipe pile with small holes or narrow slots and filled with compacted sandy soil are to be driven either vertically or at a batter in the selected grid pattern.

Closed ended pipe piles with holes/slots and filled by compacted sandy soil when driven in soils and intermediate geomaterials shall (i) densify each and every layer within the design depth, (2) reduce amount of settlement, (3) reduce or eliminate down-drag in cohesive soils and increase pile load capacity significantly. Settlements shall occur in precompression.

(ii) Closed-ended Porous Pipe Displacement piles

In this application, closed-ended porous pipe displacement piles are considered those which can own their own and alone, allow free flow of water/fluid and also prevent migration of in-situ particles into it, both during driving and later during consolidation of saturated or partially saturated soils. Porous displacement piles comprising closed-ended porous piles shall consist of very small holes/very narrow slots (108) as shown in FIG. 3. However, the said pipe shall have the filtration capacity for the given in-situ soil condition, in which the said pipe is to be driven. Because the filtration capacity of very small holes or very narrow slots for given in-situ soil condition in which the said porous displacement pile is to be driven, has been verified and found adequate, therefore the pipe sections can remain empty without any need to fill them by sandy soils. This type of closed-ended porous pipe piles can be represented by a perforated pipe. The perforated pipe is a kind of pipe that has had a pattern of holes drilled or stamped into it by a machine. Another method for creating perforated metal sheets is repeatedly pressing a metal "perforation die" containing rows of needles down on the sheet metal as it rolls through a punch press. Laser perforation is a non-contact method of metal perforation that uses lasers to accurately burn small holes in the metal with a high level of consistency. For 'hot perforation', the pins are heated, which slightly melts the edges of the metal as they push through the sheet. As the metal cools, it creates a reinforced welt around each hole. Another method of creating perforated metal is repeatedly pressing a metal 'perforation die' containing rows of needles down on the sheet metal as it rolls through a punch press. From a perforated metal sheet, the metal sheet can be rolled into a circular shape and the joint butt or lap welded to make it in the form of pipe section, in a similar way, various kinds of the pipe piles with no holes are manufactured. The pipes and metal sheets can also be directly perforated by any selected method by manufacturers.

There is another technique which has been developed recently, which is based on a porous metal filter. The porous metal filter is also called sintered powder filter. It is made of metal powder as the raw material, without the need to add a binder. After being formed by cold isostatic pressing, it is formed by high temperature vacuum sintering. The size and distribution of pores by matching the metal powder particle size and process parameters is suitably adjusted. It can be processed into plate, disc, tube etc., as required. At the present time, the tube, disc etc., are used for filtering water and their diameters are limited to generally between 2" to 4". Since it is a new process, it is very costly. As this technique becomes popular with an increase in volume of their sales and the technology further improves, then costs may come down and the manufacturing could get extended to pipes, 6" to 10" inches in diameter. If it is economical, then this technique could be used as porous displacement piles to densify the subsurface soils.

The existing tests such as those in Design Standards No. 13: Embankment Dam, Bureau of Reclamation, FIG. 5.6.1.1-2: NEF Test apparatus to determine the filtration capacity (Pabst et. al., 2015) have been devised to check the filtration capacity of sandy soils. The said apparatus has been appropriately modified in this application for checking the filtration capacity of a porous plate, such as a porous plate having very small holes or very narrow slots, or a porous concrete plate, as shown in FIG. 5. The porous plate shall have the same size of very small holes or very narrow slots in the same grid pattern as in the closed ended porous displacement pile comprising closed ended pipe porous piles. The porous plate may also be made of a sintered powder filter to represent a porous displacement pile made of sintered powder filter. This modified schematic for this apparatus comprises the said porous plate (202) as described above. The said plate shall be provided with water-proof contact to the inside of the test chamber by the side sealant (205). The porous plate (202) shall be placed on the circular ring (203). The sealant between circular ring and porous plate shall also be sealed with adhesive sealant to a circular ring (205) to make the contact waterproof. The circular ring (205) shall be attached to the inside chamber wall (209) by sealant or butt welding. Water/fluid with high pressure shall enter the top of the chamber through a pipe (206), the measurement of water/fluid pressure shall be measured by a pressure gage (207). Water/fluid under pressure first enter in to gravel (200) which fills the space at the top portion of the chamber resting on a table (208). After passing through narrow channels of the gravel mass, water/fluid under pressure shall enter in to the compacted impervious base (silty sandy soil or silty clayey or clayey soils), compacted in the space (201) at the same density as in-situ soil in which the porous displacement pile is to be driven. After passing through the compacted impervious base, the water/fluid shall enter and pass through the porous plate (202). The porous plate should allow free flow of water and prevent migration of in-situ soil. The water/fluid after passing through the porous plate shall then enter in the narrow channels of the gravel which fills the chamber in space (200). The pressure in the fluid near the bottom of the impervious base and in the gravel (200) shall be measured by pressure gages (210) and (211) for any pressure loss. Water/fluid shall exit the chamber through a pipe (212) and shall be collected in a graduated cylinder (204) for measuring rate of flow. The quality of water shall be examined for contamination by in-situ soil if any from time to time.

The non-displacement pile is driven into the ground first, in order to minimize or prevent heaving at the ground surface or at the top the layer which is to be densified and the porous displacement pile is driven through inside the non-displacement pile. Ideally, during driving the displacement pile, there should not be any heave of the ground surface to achieve maximum lateral displacement of the soil by the porous displacement pile, in order to achieve maximum densification. That is why to minimize heave, first a non-displacement pile is driven to selected depth and then the displacement pile is driven through the non-displacement pile. If this step of driving displacement pile through a non-displacement pile is omitted and displacement pile is driven directly, due to economics or for any other reason or when non-displacement pile has not been driven to adequate depth to minimize or prevent heave, then although full densification of in-situ soil may not occur due to some heave at the ground surface, the in-situ test results may indicate that required degree of densification in the layer or layers requiring densification has been achieved. Anyway, in such cases, the amount of densification will be less as the volume of the in-situ soil displaced by the displacement pile will be sum of the reduction of voids in the in-situ soil plus the volume soil which heaved if any, at the ground surface or at the top of the layer to be densified. In certain soil conditions such or soft or very soft silty sandy soils, or silty clays or clays, driving non-displacement piles first then driving porous displacement piles through inside of the non-displacement piles becomes important to prevent mud wave or flow of such said soils sideways around the piles, if this happens no densification may occur. The overburden soil above the depth of the bottom of the non-displacement pile (120) acts to prevent or minimize the heave at the ground surface to a reasonable limit. In most cases, the depth of a non-displacement pile equal between 4 and 7 times the diameter of the porous displacement pile or more will reasonably reduce or minimize the amount of heave at the ground surface. However, not enough or substantial research is available at the present, to predict the reasonable depth (121) in different types of soils at various densities or consistencies to prevent or minimize the heave at the ground surface when a displacement pile is being driven into the ground. Sufficient research shall be developed to predict the reasonable depth (121) in different types of soils at various densities or consistencies, when the projects involving ground improvement using the porous displacement piles are being implemented. In any case, whether non-displacement has been installed or not installed, the porous displacement must provide free flow of excess pore-water to dissipate excess pore-water pressures and prevent migration of particles of in-situ soil during flow of water in the porous displacement piles.

The closed ended pipe pile with very small holes or very narrow slots shall be checked by Wave Equation Analyses to verify that the driving stresses are not exceeded in the said pipe pile for the subsurface soil conditions in which the said pile is to be driven by a selected hammer. Determination of filtration capacity of closed ended pipe pile with very small holes or very narrow slots shall be determined using the modified laboratory tests, as shown in FIG. 5, and the said pipe pile shall be used as a porous displacement only when it satisfies the filtration criteria of allowing free flow of the pressurized pore water and prevents the migration of particles of in-situ soil. When the porous displacement piles comprising closed-ended pile with very small holes or very narrow slots, adjoining to the first porous displacement pile in a grid pattern are installed, the length of the drainage path is further reduced to half the spacing between adjoining porous displacement piles, allowing rapid consolidation and densification of the layer of clayey soil which causes increase of its density and consistency sufficiently enough to support loads of the required structure, such as pavement, civil structure, airport or oil storage tank, etc. Installing the porous displacement piles in the layer of loose or medium dense or dense sand layer in a grid pattern results in the instantaneous increase in its density. Therefore, the rapid consolidation and densification method using porous displacement piles comprising closed-ended pile with very small holes or very narrow slots, presented in this application as an invention, improves and increases the density of all types of soils and intermediate geomaterials to support loads of the structures of a project. When being driven in to the ground, the very small holes or very narrow slots of the said pile already in the ground shall not allow any intrusion of fine particles of the in-situ soil. The porous displacement piles comprising the closed ended pipe pile with very small holes or very narrow slots are to be driven either vertically or at a batter in the selected grid pattern.

Closed ended porous pipe piles when driven in soils and intermediate geomaterials shall (i) densify each and every layer within the design depth, (2) reduce amount of settlement, (3) reduce or eliminate down-drag in cohesive soils and increase pile load capacity significantly. Settlements shall occur in precompression.

(iii) Precast Prestressed Porous Concrete Piles

Precast prestressed concrete piles are vital elements in the foundation of buildings, bridges and marine structures throughout the world. Presently precast prestressed piles are in use in the industry in various shapes which can be circular solid, circular hollow, square solid, square hollow or orthogonal solid, orthogonal hollow, and cylindrical hollow in shape and can vary in size generally between 12" (30.48 cm) and 24" (61 cm). The prestressed concrete cylinder piles with outside diameter of generally between 36" (91.44 cm) and 66" (167.64 cm) with a cylindrical hole placed centrally and width of between 5 (12.7 cm) and 6.5" (16.51 cm) are also being used to provide large pile capacity. The prestressed concrete piles are reinforced with tendons or wire-strands spaced in a grid pattern surrounded by spiral wire at the selected pitch spacing. All these prestressed concrete piles are impervious or do not allow free flow of water through them. The prestressed concrete piles cannot densify the in-situ cohesive soils, as excess pore water pressures developed during their penetration in to the cohesive soils cannot get dissipated through them to densify the cohesive soils. Therefore, for densifyinq in-situ cohesive soils, it is necessary that precast prestressed concrete piles should be porous to provide free flow of the pressurized pore-water pressure through them to dissipate developed excess pore-water pressures, without permitting migration of in-situ cohesive soil and also to allow free flow of water. For that purpose, the invention in this application is for precast prestressed porous concrete pile. The precast prestressed porous concrete piles shall be manufactured in all shapes or sizes, in which presently precast prestressed piles are being manufactured in the industry.

The applicant and inventor of this application has already received a U.S. Pat. No. 11,124,937 for his application Ser. No. 17/075,244 for prestressed reinforced porous concrete piles. This application now being submitted and being filed today is a continuation-in-part of application Ser. No. 17/075,244 and 17/090,858. In today's application, the laboratory test methods to determine filtration capacity (i.e., capacity to allow free flow of water through the porous concrete and to prevent migration of particles of in-situ soil in which the precast prestressed concrete piles has been driven) and other important technical information for the precast prestressed porous concrete piles has been added and provided, in addition to adding other necessary technical information to support other types of porous displacement piles.

Brief Detail of Concrete Mix for Precast Prestressed Pore Concrete Piles

The precast prestressed porous concrete piles may generally contain (i) Portland cement conforming to Type I, II, III (for early strength), (ii) in areas of moderate sulfate-containing waters, tri-aluminum content of cement to be limited to 8% or less, (iii) fly ash, slag cement, silica fume or pozzolanic materials, (iv) coarse aggregate, (v) water, (vi) admixtures, (vii) air-entrained concrete, (viii) water-reducing agent (including those for self-consolidating concrete), retarding admixtures, and (ix) corrosion inhibitors such as calcium nitrate for concrete piles exposed to sea-waters, or where potential for chloride attack is high. The concrete in precast, prestressed porous concrete piles and build-ups should have (not necessary in all situations) compressive strength of 5000 psi (34.5 MPa). Steel reinforcement consists of wire-strands (epoxy-coated if necessary), spiral reinforcement and non-tensioned steel reinforcement (only when necessary). The manufacturer of precast prestressed concrete piles could choose and use his own concrete design mix as considered necessary.

Gap-graded conventional porous concrete (CPC, i.e., no fines concrete, where the fine aggregate is omitted entirely) is obtained using a uniform size of coarse aggregate at low-water cement ratio (W/C), however it shows poor workability (<30%), needs vibration equipment for proper compaction and curing for the production of precast products and pavement applications (Bhutta et. al., 2012). CPC design mixes generally have been made with aggregate sizes between 1.5-¾" (38.1-19 mm) or ¾"-⅜"(19-9.52 mm) or ⅜-3⁄16" (9.52-4.76 mm). Research has shown that when all other mix elements are equal, aggregate sizes are decreased, then the compressive strength of porous concrete increases. Therefore, for the invention of this application, aggregate sizes of 4.74-2.36 mm (3⁄16-0.093") and 2.36-1.18 mm (0.093-0.0465") shall also be used for CPC mixes to determine the increase in strength with smaller aggregate sizes. (High-performance porous concrete (HPPC) does not require any special equipment and curing. HPPC with high water-reducing and thickening (cohesive agents), used for self-compaction of HPPC, exhibited good permeability with no segregation or bleeding, and developed high strength compared to CPC. Butta et. Al., 2012) used three HPPC mixes with three different sizes of crushed coarse aggregates, first with sizes of 13-20 mm (0.5-0.8"), second with 5-13 mm (0.2-0.5") and third with 5-13 mm (0.1-0.2"), and with void ratio of 18-25%, coefficient of permeability of 0.25 to 3.3 cm/second, and compressive strength of about 35 MPa. There is a European Patent No. EP 0 936 040 B1 (Hiroaki et. al., 2004), granted on 11 Aug. 2004 (which expired in 2019) for HPPC. Three HPPC mixes were used in this patent, first with aggregate sizes of 10-20 mm (0.39-0.79"), second with 2-10 mm (0.078-0.39"), and third with 2 to 5 mm (0.078-0.195"). Following table (Hiroaki, et. al., 2004) summarizes the results:

TABLE 1

One Combination (Hiroaki, et. al., 2004)

| Description | Example 1 | Example 2 | Example 3 |
|---|---|---|---|
| Diameter of aggregate | 10-20 mm (0.4-0.8") | | |
| Ratio of water to cement (%) | 28 | | |
| Ratio of cement to aggregates (%) | 17 | | |
| Unit Cement Weight Kg/m$^3$ | 260 | 295 | 470 |
| Unit Aggregate Weight, Kg | 1560 | 1500 | 1150 |
| Unit Latex Weight, Kg/m$^3$ | | | |
| Compressive Strength, Kg/cm$^2$ | 100-200 | 100-200 | 250-300 |

TABLE 2

Second Combination (Hiroaki, et. al., 2004)

| Description | Example 1 Mortar Concrete | Example 2 Concrete | Example 3 Polymer Concrete | Example 4 Light Weight Bubble Concrete |
|---|---|---|---|---|
| Diameter of aggregate | 0-5 mm (0-0.2") | 1-10 mm (0.04-0.4") | 0-5 mm(0-0.2") | 0-5 mm(0-0.2") |
| Ratio of water to cement (%) | 45 | 30 | 40 | 45 |
| Ratio of cement to aggregates (%) | Not Reported | | | |
| Unit Cement Weight Kg/m$^3$ | 460 | 440 | 240 | 400-500 |
| Unit Aggregate Weight, Kg | 1100 | 1200 | 1400 | |
| Unit Latex Weight | | | 80 | |
| | | | | Aluminum Powder Agent |
| Compressive Strength, Kg/cm$^2$ | 300-400 | 400-500 | 400-500 | 50-100 |

Porous concrete has not been used for precast prestressed piles so far. For the invention of this application, an appropriate concrete mix for porous concrete to be used for precast prestressed porous concrete piles shall be developed with the objective of developing minimum compressive strength 5000 psi (34.5 MPa) at 28 days. For development of porous concrete for precast prestressed porous concrete piles, both CPC and HPPC mixes will be tried using locally available aggregate and tested for compressive strength and filtration capacity etc., to determine their suitability for commercial production of precast prestressed porous concrete piles.

Laboratory Tests to Determine Filtration Capacity of Porous Concrete to be Used in Precast Prestressed Porous Concrete Piles The laboratory test method to determine filtration capacity of precast prestressed porous concrete piles shall be determined as explained in FIG. 5. In the said apparatus, porous plate (202) shall have the identical properties of porous concrete as in the precast-prestressed porous concrete piles. This modified schematic for this apparatus comprises the said porous concrete plate (202). The said plate shall be provided with water-sealed contact to the inside of the test chamber by the side sealant (205). The said porous plate (202) shall be placed on the circular ring (203). The sealant between the circular ring and the said porous plate shall also be sealed with adhesive sealant to a circular ring (205) to make the contact waterproof. The circular ring (205) shall be attached to the inside chamber wall (209) by sealant or butt welding. All other provisions of the laboratory test setup shall be the same as detailed in FIG. 5, in the section 4(*d*) which deals both for the closed-ended porous pipe piles and for precast prestressed porous concrete piles.

The non-displacement pile is driven into the ground first, in order to minimize or prevent heaving at the ground surface or at the top the layer which is to be densified and the porous displacement pile is driven through inside the non-displacement pile. Ideally, during driving the displacement pile, there should not be any heave of the ground surface to achieve maximum lateral displacement of the soil by the porous displacement pile, in order to achieve maximum densification. That is why to minimize heave, first a non-displacement pile is driven to selected depth and then the displacement pile is driven through the non-displacement pile. If this step of driving displacement pile through a non-displacement pile is omitted and displacement pile is driven directly, due to economics or for any other reason or when non-displacement pile has not been driven to adequate depth to minimize or prevent heave, then although full densification of in-situ soil may not occur due to some heave at the ground surface, the in-situ test results may indicate that required degree of densification in the layer or layers requiring densification has been achieved. Anyway, in such cases, the amount of densification will be less as the volume of the in-situ soil displaced by the displacement pile will be sum of the reduction of voids in the in-situ soil plus the volume soil which heaved if any, at the ground surface or at the top of the layer to be densified. In certain soil conditions such or soft or very soft silty sandy soils, or silty clays or clays, driving non-displacement piles first then driving porous displacement piles through inside of the non-displacement piles becomes important to prevent mud wave or flow of such said soils sideways around the piles, if this happens no densification may occur. The overburden soil above the depth of the bottom of the non-displacement pile (120) acts to prevent or minimize the heave at the ground surface to a reasonable limit. In most cases, the depth of a non-displacement pile equal between 4 and 7 times the diameter of the porous displacement pile or more will reasonably reduce or minimize the amount of heave at the ground surface. However, not enough or substantial research is available at the present, to predict the reasonable depth (121) in different types of soils at various densities or consistencies to prevent or minimize the heave at the ground surface when a displacement pile is being driven into the ground. Sufficient research shall be developed to predict the reasonable depth (121) in different types of soils at various densities or consistencies, when the projects involving ground improvement using the porous displacement piles are being implemented. In any case, whether non-displacement has been installed or not installed, the porous displacement must provide free flow of excess pore-water to dissipate excess pore-water pressures and prevent migration of particles of in-situ soil during flow of water in the porous displacement piles.

The precast prestressed porous concrete piles shall be checked by Wave Equation Analyses to verify that the driving stresses are not exceeded in the said precast prestressed porous concrete pile for the subsurface soil conditions in which the said porous concrete pile is to be driven by a selected hammer. Determination of filtration capacity of the precast prestressed porous concrete pile shall be determined using the laboratory tests, as shown in FIG. 5, and the precast prestressed porous concrete pile shall be used as a porous displacement pile only when it satisfies the filtration criteria of allowing free flow of the pressurized pore water and preventing the migration of particles of in-situ soil. When the porous displacement piles comprising precast prestressed porous concrete piles, adjoining to the first porous displacement pile in a grid pattern are installed, the length of the drainage path is further reduced to half the spacing between adjoining porous displacement piles, allowing rapid consolidation and densification of the layer of the cohesive soil, which therefore, causes increase of its density and consistency sufficiently enough to support loads of the required structure, such as of pavement, civil structure, airport or oil storage tank, etc. Installing the porous displacement piles in the layer of loose or medium dense or dense sand layer in a grid pattern results in the instantaneous increase in its density. Therefore, the rapid consolidation and densification method using porous displacement piles comprising precast prestressed porous concrete piles, presented in this application as an invention, improves and increases the density of all types of soils and intermediate geomaterials to support loads of the structures of a project. The porous displacement piles comprising the prestressed concrete piles are to be driven either vertically or at a batter in the selected grid pattern.

Precast prestressed concrete piles when installed on batter, particularly to support bridge abutments and retaining walls, have been reported to crack or even fail in certain soil conditions depending also on the height of the abutment. The precast prestressed porous concrete piles when installed on a batter shall densify soil even in cohesive soil and are therefore not likely to crack or fail because soil around the length of batter pile is much dense after densification. Precast prestressed concrete piles are provided with longitudinally straight alignment along its length, unlike prestressed concrete beams, in which tendons or wire strands are provided on camber to develop flexural/bending strength. For many high retaining walls or bridge abutments, if design indicates that cracking of precast prestressed porous concrete on batter may even then reach peak stress conditions, then non-tensioned steel reinforcement (Shaikh and Branson, 1970) shall also be provided to satisfy the design. A detailed design and details with both prestressed tendons/wire strands and non-tensioned steel reinforcement shall be worked out along with conducting an experimental program of testing and making such precast prestressed porous concrete piles on batter, prior to making commercial production of such piles.

Precast prestressed porous concrete piles when driven in soils and intermediate geomaterials shall (i) densify each and every layer within the design depth, (2) reduce amount of settlement, (3) reduce or eliminate down-drag in cohesive soils and increase pile load capacity significantly. Settlements shall occur in precompression.

(8) TYPICAL EXAMPLES OF INDUSTRIAL APPLICATIONS OF THE POROUS DISPLACEMENT PILE

The following examples for industrial applications explained in this section are for using porous displacement piles comprising of (i) a closed ended porous pipe pile with small holes/slots and filled in layers and each layer compacted to a specified relative density, (ii) a closed ended pipe pile with very small holes or very narrow slots, (108) and (iii) a porous precast prestressed concrete pile (107), with the condition that all these types porous displacement piles meet the filtration criteria, shall provide an economical and very useful solution. Any of three types of porous displacement pile as mentioned above can be used in the following examples to rapidly consolidate and densify a subsurface layer or more than one subsurface layer of soils and intermediate geomaterials of the soil deposit. In geotechnical engineering, each and every project site has their unique subsurface soil conditions, requiring separate designs and details about configurations of porous displacement piles and non-displacement piles. The decision about these details is taken after performing subsurface exploration at a site and completing the analyses, and then design and details about the configurations, depths and grid spacing of porous displacement piles and non-displacement piles are developed to achieve increase in density of the subsurface layers as required by the project specifications and drawings. Before starting the project for densification, the subsurface exploration to determine soil properties and depths and thicknesses of each layer can be done by SPT, Laboratory testing on the samples extracted from inside the ground, CPT, CPTu, PMT, dilatometer and other testing methods used in geotechnical engineering. The subsurface exploration is repeated after completion of the rapid consolidation and densification work, to verify that the densification as required by specifications and drawings has been achieved. When compacted sandy soil is performing the function of the filter, then value of $D_{15}$, $D_{50}$ and $D_{85}$ of the in-situ soil (base soil) and of the sandy soil is determined during subsurface exploration. But when the displacement porous pipe piles and precast prestressed concrete piles perform function of a filter then filter design criteria is based on the laboratory tests. The examples or the illustrations shown in this application cannot cover all the unknown subsurface conditions of a site, and therefore, it becomes necessary to design the rapid consolidation and densification schemes using porous displacement piles as considered necessary for a project site, which may be different than what is shown in this application.

(i) Ground Improvement Under a Spread Footing

For example, a spread footing for foundations of bridge piers or abutments or other structures is to be found on soil which consists of a weak layer of soil (140) and needs soil improvement in order to support the loads from the structures. FIG. 6A shows a typical layout plan of the grid lines (151) and location of the center of porous displacement piles (150) in a square or rectangular grid pattern. The locations marked by number "1" at the grid intersection (150) are the primary locations where the porous displacement piles shall be installed first, using the method described in the above paragraphs. The locations marked by number "2" at the grid intersection are the secondary locations where the porous displacement piles shall be installed after completing the installation at the primary locations. The secondary locations are usually selected at the center of the grid of four primary locations. The locations marked by number "3" at the grid intersection are the tertiary locations where the porous displacement piles shall be installed after completing the installation at the secondary locations. The locations marked by number "4" at the grid intersection are the final and last locations where the porous displacement piles shall be installed after completing the installation at the tertiary locations. A similar arrangement for locations of the porous displacement piles can also be made in a triangular pattern or quadrilateral or hexagonal pattern or any other pattern same way as is done for vibro-replacement columns. Any other grid pattern selected for a particular configuration at a project site can also be used.

FIG. 6B shows a sectional elevation view of the grid pattern shown in FIG. 7A. In FIG. 7B, reinforced concrete foundation (146) has been laid over mud mat (147). The porous displacement piles consisting of compacted sandy materials are installed to the design depth in the layer, which in this case lies in the soil layer (141). CASE 1: Assume top Layer (142) and bottom layer (141) consists of sandy material and the sandwiched layer (140) consists of soft clay. In this case the porous displacement pile can be driven from the ground surface without driving a non-displacement pile first, if the layer (142) is sufficiently thick to reasonably minimize the heave at the top of the weak layer (140), in such cases there appears to be no advantage to drive non-displacement first and then drive the displacement pile through inside it. Anyway, there is also no problem to drive non-displacement pile first and then drive the porous displacement piles through inside the non-displacement pile. CASE 2: Assume the top layer (142) consists of Clay and the sandwiched layer (140) consists of loose sand and requires densification. In this case, it is advisable to drive the non-displacement pile first to the bottom of the top layer (142) or to some small depth in the loose sand layer (140) and it shall also be advisable to auger out the clayey soil from inside the non-displacement pile and then drive the porous displacement pile to the design depth. This shall avoid pushing the clayey soil into the loose sand layer, which can prevent instantaneous densification of the loose sand layer. Therefore, at each project, the subsurface soil profile shall be carefully examined and the installation method carefully designed. In some cases, the design may not require installation of porous displacement piles at tertiary (3) or final grid locations (4).

(ii) Ground Improvement Under Embankments

The porous displacement piles can be used under mechanically stabilized walls (such as reinforcement earth wall) to reduce and limit their settlements and also to develop required stability. The slopes which are found not to have enough factor of safety based on slope stability analyses when densified by use of the porous displacement piles, shall be able to develop required factor safety for slope failures. The road and highway embankments founded on very soft layers of soils sink and settle sometimes by several inches or feet or meters; and slopes of 2H:1V generally provided on opposite sides of the embankment are found to be unstable, therefore requiring very flat slopes. In such cases the porous displacement piles shall densify the weak or soft soils under the embankments and reduce settlements to the reasonable limits and also improve the slope stability of the embankment slopes without requiring flatter slopes. One typical example is shown in FIG. 7A and FIG. 7B. As shown in FIG. 7A, a layer (142) of sandy material is first laid over very soft clayey soil to build an embankment of low height where the equipment can be brought to install the porous displacement piles. After the installation of the porous displacement piles, the embankment is further raised to full height by additional layers (143). As shown in FIG. 7B, the clayey soil is very weak and it cannot even support the embankment of low height to bring the equipment on it, then the porous displacement piles on primary locations (or even on secondary locations) can be installed ahead of the embankment of low height and then the embankment is extended further and then the porous displacement piles on secondary and tertiary locations can be installed.

The porous displacement piles can also be used in coastal regions where embankment is to be further extended into the ocean to build new land for airports and housing projects etc., and where the subsurface soils consist of loose sands and soft to very soft clays. Similarly, new islands can be built even where subsurface soils consist of loose and soft and very soft soils underlies as these subsurface soils can be densified by the rapid consolidation and compaction method. To reduce down drag on the piles driven in clayey and silty soils, the sand drains or PVC (wick) drains are installed and an embankment is built over them to consolidate the clayey silty layer for certain time period for generally up to 90% consolidation and then sometimes the embankment is removed and the piles are driven. In place of sand drains or wick drains, the porous displacement piles can be used, which shall rapidly consolidate the layer without requiring to build an embankment and waiting for up to 90% consolidation. The porous displacement piles can be used very economically for any layer of soils or intermediate geomaterial where soil improvement to densify it is required and also, where ever, presently existing methods such as jet grouted columns, columns of cement or lime mixed with clayey material or Geopiers or vibro-replacement or vibro-floatation using a Vibro-probe, stone-columns as bottom feed or top feed, etc., are being used.

(iii) Ground Improvement Under Tilting or Leaning Structures Such as the Leaning Tower of Pisa There are many structures throughout the world which have tilted either during construction or after completion of the construction. The ground improvement using the porous displacement piles can improve the foundation soils which will also result in reducing the angle of tilt significantly and bring the leaning structure close to about vertical. There are many other structures in the Town of Pisa, Italy, which are tilting like the Leaning Tower of Pisa, but not as much as the Leaning Tower of Pisa. First the porous displacement piles may be installed at other tilting structures of Town of Pisa to demonstrate the effectiveness of soil improvement in succeeding to reduce the tilt with underlying subsurface conditions, before considering to install porous displacement piles at the Leaning Tower of Pisa to reduce the tilt. To reduce the angle of tilt of the Leaning Tower of Pisa, (i) the lead weights have been placed on the north side on prestressed concrete ring around the foundation of the leaning tower of Pisa, (ii) steel cables to anchor the tower on north side to limit movement towards south, (iii) Drill holes installed to remove soil from the drilled holes on the north side, and (iv) some excavation in east-west direction (Jamiolkowsky, et al., 1993). However, no construction on the southside has been permitted and even subsurface exploration consisting cone penetration soundings has been permitted 10 to 20 meters from the south edge of the tower in order not to disturb the tower, although construction as stated above has been permitted on the north side. Prior to installation of porous displacement piles, the additional steel cables to anchor the tower could be considered to further anchor the tower by steel cables in north-east and north-west directions. If permission is granted by the concerned authorities, the scheme of installation of porous displacement piles as shown in FIG. 9 and FIG. 10 could be worth consideration to consolidate and densify the upper clay (named locally as Pancone Clay) between El. −7 m and −18 m, which has cone penetration resistance, $q_c$, only between 1 to 1.5 MPa (Jamiolkowsky, et al., 1993). The porous displacement piles can be proposed to be installed at a batter of about 1V:2H (or even between 1V:3H and 1V:1H as considered necessary), in order to achieve densification of the upper clay (163) and to possibly lift the foundation of the south side of the Leaning Tower of Pisa. When Upper Clay (160) is densified, its bearing capacity shall increase resulting in less settlement on the south side. When the angle of tilt is reduced, the bearing pressure on the south side will reduce and the bearing pressure on the north side will increase, causing more settlement on the north side and reducing settlement on the south side of the tower foundation. Also, after stabilizing and densifying the Upper Clay (163), the tendency to further tilt on the south side of the tower foundation in future will be prevented. The following description is to demonstrate the industrial application of the ground improvement under a leaning structure to reduce its tilt. For that purpose, the Leaning Tower of Pisa has been selected. Following steps are advisable to implement the scheme:

1. Perform subsurface investigation near the south side of the tower.
2. Install instruments to monitor vibrations and settlements both on ground surface and in selected depths below the ground surface and around the tower above the ground level.
3. Perform radar survey at designated points around the tower above ground level, before and during implementation of the scheme.
4. FIG. 8 shows the grid lines (151) and the locations (150) at grid line intersections, where the porous displacement piles could be installed.
5. FIG. 9 shows: (a) Ground surface elevation as El. 3.0 m (170), (b) elevation of the bottom of Clayey and Sandy yellow silt (162) as El. −7 m (171), (c) the elevation of the bottom of Upper Clay (163) as El. −18 m (172), (d) the elevation of the bottom of the Intermediate Clay (164) as El. −22.5 m (173), (e) the elevation of the bottom of the Intermediate Sand (164) as El. −24.5 (173), and (f) Lower Clay (166) underlies the intermediate sand (165).
6. The outside diameter of tower foundation (162) is 19.58 m with 4.5 m diameter circular space in the center. Lower portion of the tower is designated as reference number 161 in FIG. 10. Non displacement piles (120) at a batter of 1H:2V are proposed to be driven first up to the bottom level of the foundation of the tower. The porous displacement piles can then be driven through the non-displacement pile (120) to penetrate some small distance in the Intermediate Clay (164). Then the non-displacement pile can be withdrawn. The porous displacement pile (125) numbering from 1 through 5 shall be driven first as shown in this figure.
7. The porous displacement piles at Grid Intersection Location No. 1, which is 15 meters from the south edge of the Leaning Tower, and then at Location No. 2 about 12 meters from the south edge, followed by at Location No. 3 at 9 meters from the south edge, at Grid location 4 at 6 meters from south edge and Grid intersection location no. 5 at 3 meters from the south edge could be installed successively, to monitor and observe the settlement, vibrations and movements etc., continuously and to analyze the effects of installing the porous displacement piles around the tower when their locations get closer to the tower foundations.
8. When recorded data has been analyzed to determine the safety of the tower and when found satisfactory after installation of each porous displacement pile, then only the installation of the remaining porous displacement piles could be considered.
9. If permitted by the authorities, the installation at primary location in the following order could be considered: primary locations 6 through 13, then 14 through 21.
10. After analyzing the data and considering it satisfactory to move ahead, then installation at tertiary location in the following order could be considered: Locations 22 through 27, then 28 through 47 could be considered. Tertiary locations could be considered after evaluating the reduction in tilt of the leaning tower.
11. Subsurface exploration to be done to evaluate the improvement of properties of Upper Clay after completion of the construction of porous displacement piles.
12. Although only installing the batter porous displacement piles has been shown in FIG. 10, the vertical porous displacement outside the tower foundation in addition to those shown in FIG. 8 and FIG. 9 could also be installed to improve the density of upper clay outside of the tower foundation. The dispersion of the load of tower or any foundation is considered to occur at a slope of about 60 degrees.

(iv) Densification Under a Structure Undergoing Settlement

When a structure such as a building or an oil or water tank is continuously undergoing settlement on all of its sides, then batter porous displacement piles on all sides penetrating under the structure could be installed to prevent or reduce further settlements significantly. The batter displacement piles shall be required to be installed in particular sequence, so that at any instant, these are evenly located symmetrically around a structure. All displacement piles shall be driven through inside the non-displacement piles. The selection shall be made for a particular site based on soil conditions and environment around the structure.

(v) Densification in Earthquake Zones

In many areas such as in earthquake zones, the local building code may not allow construction unless the relative density is above a certain value. Table 1 gives liquefaction-potential relationships between magnitude of earthquake and relative density for a water table 1.5 m below ground surface:

TABLE 1

Approximate relationship between earthquake magnitude, relative density ($D_r$)and liquefaction potential for water table 1.5 m below ground surface (From Seed and Idriss, 1971)

| Earthquake Acceleration | High Liquefaction Probability | Potential for liquefaction depends on soil type and earthquake acceleration | Low Liquefaction Probability |
|---|---|---|---|
| 0.10 g | $D_r < 33\%$ | $33\% < D_r < 54\%$ | $D_r > 54\%$ |
| 0.15 g | $D_r < 48\%$ | $48\% < D_r < 73\%$ | $D_r > 73\%$ |
| 0.20 g | $D_r < 60\%$ | $60\% < D_r < 85\%$ | $D_r > 85\%$ |
| 0.25 g | $D_r < 70\%$ | $70\% < D_r < 92\%$ | $D_r > 92\%$ |

In such cases, porous displacement piles shall be very useful to densify the in-situ sandy soils to relative density exceeding 54% for liquefaction potential of 0.1 g, 73% for liquefaction potential of 0.15 g, 85% for liquefaction potential of 0.20 g, and 92% for liquefaction potential of 0.25 g by varying the grid spacing of the porous displacement piles depending on their diameter under the footprint of the buildings, warehouse and structures or also under separate footings, like that a bridge pier. The porous displacement piles to densify the sandy silty soils and cohesive soils under and around the footprint of spread footings shall also be very useful to reduce the settlements and also to increase pile capacity many times more than the non-porous displacement piles which do not have any filtration capacity.

(9) TEACHINGS OF THIS APPLICATION

The various aspects of what is described in the above sections, can be used alone or in other combinations for other types of applications. The teaching of this application is not limited to the industrial applications described herein-before, but it may have other applications. Therefore, teaching of the present application has numerous advantages and uses. It should therefore be noted that this is not an exhaustive list and there may be other advantages and uses which are not described herein. Although the teaching of the present application has been described in detail for the purpose of illustration, it is understood that such detail is solely for that purpose, and variations can be made therein by those skilled in the art without departing from the scope of the teaching of this application. Features described in the preceding description/specification may be used in combination, other than the combinations explicitly described. Whilst endeavoring in the forgoing specification/description to draw attention to those features of the invention believed to be of particular importance, it should be understood that Applicant and Inventor claims protection in respect of any patentable feature or combinations of features hereinbefore referred to and/or shown in the drawings/figures whether or not particular emphasis has been placed thereon. The term "comprising" as used in the claims does not exclude other elements or steps. The term "a" or "an" as used in the claims does not exclude plurality or otherwise a plurality can also include in some cases as "a" or "an" depending on the situations or subsurface conditions. A unit or other means may fulfill the functions of several units or means recited in the claims. As various possible embodiments might be made of the above invention, and as various changes might be made in the embodiments above set forth, it is to be understood that all matter herein described or shown in the accompanying drawings is to be interpreted as illustrative only and not in a limiting sense and are not intended to limit the scope of invention.

(10) REFERENCES

Bhutta, A. M. R., Tsuruta, K., Mirza, J. (2012). "Evaluation of high-performance concrete properties," Construction and Building Materials, Vol. 31, Pages 67-73

Hiroaki, S., Kikuo, T., Tatsuji, T., Tatsuo, K (2004). "High strength porous concrete structure and method of manufacturing the high strength porous concrete," Patent No. EP 0 936 040 B1, European Patent Office, Geneva, Switzerland.

Jamiolkowski, M., Lancellotta, R., and Pepe, C. (1993) "Leaning Tower of Pisa-Updated Information", Proceedings, Third International Conference on Case Histories in Geotechnical Engineering, June 1-4, 1993, SOA, St. Louis, Mo., USA.

Kennedy, G. D., and Woods, K. B. (1954). "Vertical Sand Drains," Highway Research Board, Bulletin 90, Washington, D.C., USA.

Mars, B. N., "Compaction of Soil," U.S. Pat. No. 4,126,007, issued on Nov. 21, 1978, United States Patent and Trade Mark Office, Alexandria, Va., USA.

Pabst, M, McDaniel, T, Nuss, L. K., Knight, K, and Pimley, L. (2011). "Embankment Dams, Design Standards No. 13, Chapter 5: Protective Filters," Bureau of Reclamation, U.S. Department of Interior, Washington, D.C.

Peuchen, J., Berghes, J. F. V., and Coulais, C. (2010), "Estimation of $u_1/u_2$ conversion factor for piezocone," Second International Symposium on Cone Penetration Testing, California, USA.

Pile Dynamics, Inc. (2005) "GRLWEAP, Wave Equation Analysis of Pile Driving", Cleveland, Ohio, USA.

Pitt, J. M., White, D. J., Gaul, A., and Hoevelkamp, K. (2003). "Highway Applications for Rammed Aggregate Piers in Iowa Soils," Iowa Highway Research Board, Ames, Iowa, USA.

Prakash, D. and Gupta, R. C. (1972), "Laboratory Studies on Filter Materials Placed at Ramganga Main Dam," Indian Geotechnical Journal, Vol. 2, No. 3, July 1972, pp. 203-219, New Delhi, India.

Schaefer, V. R., Berg, R. R., Collin, J. G., Christofer, B. R., DiMaggio. J. A., J, A, Filz, G. M., Bruce, D. A., and Ayala, D. (2016). "Ground Modification Methods-Reference Manual", Volume 1, Geotechnical Engineering Circular No. 13, FHWA-NHI-16-027, US Department of Transportation, Washington, D.C. USA.

Seed, H. B., and Idriss, I. M. (1971) "Simplified Procedure for Evaluating Soil Liquefaction Potential", JSMFD, ASCE, Vol. 97, SM 9, September, pp. 1249-1273.

Shaikh, A. F., and Branson, D. E. (1970). 'Non-tensioned Steel in prestressed concrete beams", P.C.I. Journal, Precast/Prestressed Concrete Institute, Chicago, Ill.

White, D. J. (2005), "Open-End Extensible Shells and Related Methods for Constructing a Pier", Patent No. US 2005/0330051 A1, Issued on Nov. 19, 2005, United States Patent and Trade Mark Office, Alexandria, Va., USA.

The invention claimed is:

1. A method of installation for rapid consolidation and densification of various layers of soils and intermediate geomaterials in a soil deposit, the method of the installation comprising:

(i) installing porous displacement piles for the rapid consolidation and the densification of one layer or more than one layer of subsurface layers of the soils and/or the intermediate geomaterials;

(ii) the porous displacement pile comprising of a closed-ended pipe pile with small holes, with compacted sandy soils, compacted above ground;

(iii) to begin the installation, first inserting a closed-ended pipe section with the small holes in another pipe section to not let sandy soil spill out during compaction and holding both pipe sections vertically and laterally with vertical columns and lateral braces in a field assembly setup;

(iv) filling the sandy soil in layers in the closed ended pipe section the with the small holes and compacting each layer to a specified relative density, while the said pipe section is on ground surface being held by said field assembly setup;

(v) wherein the specified relative density of the compacted sandy soil conforming to either medium dense or dense condition;

(vi) the compacted sandy soil in the closed-ended pipe section required to be in conformance of filter design criteria to allow free flow of pressurized pore-water and pore-air and to prevent migration of particles of cohesive soil into the compacted sandy soil;

(vii) wherein verifying filtration capacity of gap-graded compacted sandy soil by an existing laboratory test method;

(viii) after completing the compaction of the sandy soil to the specified relative density, lifting the said closed ended pipe section filled with the compacted sandy soils, and transporting it to a location where it is to be driven into the ground to densify the subsurface layers of the soils;

(ix) the holes in the said closed pipe section to be so small that the compacted sandy soil to remain in place in the closed-ended pipe section without any spill from the holes during transportation to the location where it is to be driven into the ground and also during driving into the ground;

(x) driving first a non-displacement pile comprising a hollow pipe section into the ground;

(xi) driving the said closed ended pipe section through inside of the non-displacement pile into the ground to a design depth;

(xii) during driving, the compacted sandy soil to not let in-situ soil penetrate into it;

(xiii) the closed-ended pipe pile with the small holes and filled inside with the compacted sandy soil behaves as the porous displacement pile and therefore, becomes the porous displacement pile;

(xiv) the porous displacement pile comprising the closed-ended pipe section with the small holes and filled by the compacted sandy soils to be used as the porous displacement pile if drivable by a pile drivable hammer into the in-situ soil without exceeding allowable driving stresses;

(xv) the porous displacement pile after being driven into the ground occupies space previously occupied by in-situ cohesive soil and therefore, developing excess pore-water pressures in saturated in-situ cohesive soil and a combination of the excess pore-water pressures and excess pore-air pressures in partially saturated cohesive soil, by pressurizing the pore-water and the pore-air present in pores of the in-situ cohesive soil;

(xvi) the excess pore-water pressures and the pore-air pressures developed in the in-situ cohesive soil are rapidly dissipated by flow of the pressurized pore-water and the pore-air through the porous displacement pile to the ground surface or to sandy layer located within the ground, thereby rapidly consolidating and densifying the in-situ cohesive soil;

(xvii) wherein the excess pore-water pressures do not develop in the sandy soil and if develop, dissipate immediately during driving of the porous displacement piles;

(xviii) driving the porous displacement piles in a grid pattern densifies the sandy soil instantly;

(xix) installing a plurality of the porous displacement pile spaced apart in the grid pattern vertically and/or at a batter in an area requiring the densification of one subsurface layer or several subsurface layers of soils and/or intermediate geomaterials of the soil deposit.

2. The method of the installation for the rapid consolidation and the densification of the various layers of the soils and the intermediate geomaterials in the soil deposit, in accordance with claim 1, the method of the installation further comprising:

(i) determining soil properties and subsurface conditions of the subsurface layers by conducting a subsurface exploration at a project site, prior to the installation of the porous displacement piles;

(ii) wherein determining particle size distribution of the in-situ cohesive soil requiring the rapid consolidation and the densification for verifying the filtration capacity of the compacted sandy soil using the filter design criteria;

(iii) wherein spacing, diameter, depth and configurations of the non-displacement pipe piles and the porous displacement pile in the grid pattern, to depend on subsurface soil properties and conditions at the project site, and specifications and drawings requiring up to which the subsurface layers of soils and/or intermediate geomaterials to be densified at the project site;

(iv) determining the soil properties of the subsurface layers, after the installation of the porous displacement by conducting said the subsurface exploration to verify that the densification as required by the specifications and the drawings has been achieved;

(v) wherein the closed-ended pipe piles with the holes and filled by the compacted sandy soil when driven in one layer or more than one layer of the soils and/or of the intermediate geomaterials shall (i) densify each and every layer within the design depth, (2) reduce amount of settlement, (3) reduce or eliminate down-drag in the in-situ cohesive soils, and (4) increase pile load capacity significantly.

3. A method of installation for rapid consolidation and densification of various layers of soils and intermediate geomaterials in a soil deposit, the method of the installation comprising:

(i) installing porous displacement piles for the rapid consolidation and the densification of one layer or more than one layer of the soils and/or the intermediate geomaterials;

(ii) the porous displacement pile comprising of a closed-ended pipe pile with very small holes or comprising a closed-ended sintered porous pipe pile;

(iii) to begin the installation, first driving a non-displacement pipe pile comprising a hollow pipe section into ground;

(iv) driving said porous displacement pile through inside of the non-displacement pipe pile into the ground to a design depth;

(v) the closed-ended pipe pile with the very small holes should not to let in-situ soil particles penetrate into the holes during driving it into the ground and should have required filtration capacity;

(vi) the filtration capacity of the closed-ended pipe pile with the very small holes and the closed-ended sintered porous pipe pile to be checked by a laboratory test to verify whether the said pipe piles can provide free flow of pressurized water and prevent migration of the in-situ soil into it;

(vii) modifying an existing laboratory test apparatus by (a) representing the closed ended pipe pile with the very small holes or the closed-ended sintered porous pipe pile by a porous plate comprising same size holes or porosity, (b) attaching a circular ring to inside a test chamber wall, (c) placing said porous plate on the circular ring which is water-sealed by use of an adhesive sealant, (c) compacting base soil comprising of the in-situ soil in layers to a density at same moisture content as of the in-situ soil on top of the said porous plate, and (d) filling spaces in the test chamber of the laboratory test apparatus in the spaces above the base soil and below the said porous plate by gravel;

(viii) the porous displacement pile comprising the closed-ended pipe section with the very small holes and the closed-ended sintered porous pipe pile to be used as the porous displacement pile if drivable by a pile drivable hammer into the in-situ soil without exceeding allowable driving stresses;

(ix) the porous displacement pile after being driven into the ground occupies space previously occupied by in-situ cohesive soil and develops excess pore-water pressures in saturated cohesive soil and a combination of the excess pore-water pressures and excess pore-air pressures in partially saturated cohesive soil, by pressurizing the pore-water and pore-air present in pores of the in-situ cohesive soil;

(x) the excess pore-water pressures and the pore-air pressures developed in the in-situ cohesive soil are rapidly dissipated by flow of pressurized pore-water and pore-air through the porous displacement pile to ground surface or to sandy layer located within the ground, thereby rapidly consolidating and densifying subsurface layers comprising the in-situ cohesive soil;

(xi) wherein the excess pore-water pressures do not develop in sandy soil and if develop, dissipate immediately during driving of the porous displacement piles;

(xii) driving the porous displacement piles in a grid pattern to densify the sandy soil instantly;

(xiii) installing a plurality of the porous displacement pile spaced apart in the grid pattern vertically and/or at a batter in an area requiring the densification of one subsurface layer or several subsurface layers of soils and intermediate geomaterials of the soil deposit.

4. The method of the installation for the rapid consolidation and the densification of the various layers of the soils and the intermediate geomaterials in the soil deposit, in accordance with claim 3, the method of the installation further comprising:

(i) determining soil properties and subsurface conditions of subsurface layers by conducting a subsurface exploration at a project site, prior to the installation of the porous displacement piles;

(ii) wherein spacing, diameter, depth and configurations of the non-displacement pipe piles and the porous displacement pile in the grid pattern, to depend on subsurface soil properties and conditions at the project site, and specifications and drawings requiring up to which the subsurface layers of soils and/or intermediate geomaterials to be densified at the project site;

(iii) determining the soil properties of the subsurface layers, after the installation of the porous displacement by conducting said subsurface exploration to verify that the densification as required by the specifications and the drawings has been achieved;

(iv) wherein the closed ended displacement porous pipe piles when driven in one layer or more than one layer of the soils and/or of the intermediate geomaterials shall (i) densify each and every layer within the design depth, (2) reduce amount of settlement, (3) reduce or eliminate down-drag in the in-situ cohesive soils, and (4) increase pile load capacity significantly.

5. A method of installation for rapid consolidation and densification of various layers of soils and intermediate geomaterials in a soil deposit, the method of the installation comprising:

(i) installing porous displacement piles for the rapid consolidation and the densification of one layer or more than one layer of subsurface soils and/or intermediate geomaterials;

(ii) the porous displacement pile comprising of a precast prestressed porous concrete pile;

(iii) driving first a non-displacement pile comprising a hollow pipe section into ground;

(iv) driving the precast prestressed porous concrete pile through inside of the non-displacement pipe pile into the ground to a design depth;

(v) the prestressed porous concrete should not to let in-situ soil particles penetrate into the porous concrete during driving it into the ground and should have adequate filtration capacity;

(vi) filtration capacity of the prestressed porous concrete pile to be checked by a laboratory test to verify whether the precast prestressed porous concrete pile can provide free flow of pressurized pore-water and prevent migration of the in-situ soil into it;

(vii) modifying an existing laboratory test apparatus by (a) representing the precast prestressed porous concrete pile by a porous concrete plate comprising porous concrete of the same mix design and porosity as that of the porous concrete of the precast prestressed porous concrete pile, (b) attaching a circular ring to inside a test chamber wall, (c) placing the porous concrete plate on the circular ring which is water-sealed by use of an adhesive sealant, (c) compacting base soil comprising of the in-situ soil in layers to a density at same moisture content as of the in-situ soil on top of the porous concrete plate, and (d) filling spaces in the test chamber of the laboratory test apparatus in the spaces above the base soil and below the porous concrete plate by gravel;

(viii) the porous displacement pile comprising the prestressed concrete pile to be used as the porous displacement pile if drivable by a pile drivable hammer into the in-situ soil without exceeding allowable driving stresses;

(ix) the porous displacement pile after being driven into the ground occupies space previously occupied by in-situ cohesive soil and develops excess pore-water pressures in saturated cohesive soil and a combination of the excess pore-water pressures and excess pore-air pressures in partially saturated cohesive soil, by pressurizing the pore-water and pore-air present in pores of the in-situ cohesive soil;

(x) the excess pore-water pressures and the pore-air pressures developed in the in-situ cohesive soil are rapidly dissipated by flow of the pressurized pore-water and pore-air through the porous displacement pile to ground surface or to sandy layer located within the ground, thereby rapidly consolidating and densifying subsurface layers comprising the in-situ cohesive soil;

(xi) wherein the excess pore-water pressures do not develop in sandy soils and if develop, dissipate immediately during driving of the porous displacement piles;

(xii) driving the porous displacement piles in a grid pattern to densify the subsurface layers of the sandy soils instantly;

(xiii) installing a plurality of the porous displacement pile spaced apart in the grid pattern vertically and/or at a batter in an area requiring the densification of one subsurface layer or several subsurface layers of soils and intermediate geomaterials of the soil deposit.

6. The method of the installation for the rapid consolidation and the densification of the various layers of the soils and the intermediate geomaterials in the soil deposit, in accordance with claim 5, the method of the installation further comprising:

(i) determining soil properties and subsurface conditions of the subsurface layers by conducting a subsurface exploration at a project site, prior to the installation of the porous displacement piles;

(ii) wherein spacing, diameter, depth and configurations of the non-displacement pipe piles and the porous displacement pile in the grid pattern, to depend on subsurface soil properties and conditions at the project site, and specifications and drawings requiring up to which the subsurface layers of soils and/or intermediate geomaterials to be densified at the project site;

(iii) determining the soil properties of the subsurface layers, after the installation of the porous displacement by conducting said subsurface exploration to verify that the densification as required by the specifications and the drawings has been achieved.

7. The method of the installation for the rapid consolidation and the densification of the various layers of the soils and the intermediate geomaterials in the soil deposit, in accordance with claim 5, the method of the installation further comprising:

(i) 28-day compressive strength of the porous concrete for the precast prestressed porous concrete piles to be a minimum of 5000 psi (34.5 kPa);

(ii) the precast prestressed porous concrete piles on the batter, densify the soft and stiff cohesive soil all along its length, reducing the possibility of any settlement under said piles on the batter;

(iii) providing non-tensioned reinforcement rebars in addition to reinforcement by prestressed wire strands in the precast prestressed porous concrete piles, when design indicates that flexural strength of the precast prestressed porous concrete piles on the batter is needed to be increased;

(iv) the precast prestressed porous concrete pile when driven in the soils and the intermediate geomaterials shall (i) densify each and every layer within the design depth, (2) reduce amount of settlement, (3) reduce or eliminate down-drag in the in-situ cohesive soils, and (4) increase pile load capacity significantly.

* * * * *